US008952864B2

(12) United States Patent
Krupa et al.

(10) Patent No.: US 8,952,864 B2
(45) Date of Patent: Feb. 10, 2015

(54) FLAT FOLDING HINGED ANTENNA

(75) Inventors: Steve Krupa, Tempe, AZ (US); Gary Wannagot, Mesa, AZ (US)

(73) Assignee: Galtronics, Ltd., Tiberias (IL)

( * ) Notice: Subject to any disclaimer, the term of this patent is extended or adjusted under 35 U.S.C. 154(b) by 2166 days.

(21) Appl. No.: 10/589,089

(22) PCT Filed: Jul. 6, 2006

(86) PCT No.: PCT/IL2006/000786

§ 371 (c)(1),
(2), (4) Date: Jul. 27, 2011

(87) PCT Pub. No.: WO2007/007318

PCT Pub. Date: Jan. 18, 2007

(65) Prior Publication Data

US 2012/0026062 A1 Feb. 2, 2012

Related U.S. Application Data

(60) Provisional application No. 60/697,484, filed on Jul. 8, 2005.

(51) Int. Cl.

| | |
|---|---|
| ***H01Q 1/24*** | (2006.01) |
| ***H01Q 1/22*** | (2006.01) |
| ***H01Q 1/08*** | (2006.01) |
| ***H01Q 3/08*** | (2006.01) |
| ***H01Q 9/26*** | (2006.01) |
| ***H01Q 9/42*** | (2006.01) |

(52) U.S. Cl.

CPC ..... *H01Q 1/22* (2013.01); *H01Q 1/084* (2013.01); *H01Q 1/2275* (2013.01); *H01Q 3/08* (2013.01); *H01Q 9/265* (2013.01); *H01Q 9/42* (2013.01)

USPC ..... 343/906; 343/702

(58) Field of Classification Search

USPC ..... 343/702, 906; 439/916

See application file for complete search history.

(56) References Cited

U.S. PATENT DOCUMENTS

| | | | | |
|---|---|---|---|---|
| 5,764,190 | A | 6/1998 | Murch et al. | |
| 6,292,148 | B1 | 9/2001 | Matsuura et al. | |
| 6,680,705 | B2 | 1/2004 | Tan et al. | |
| 6,707,431 | B2 | 3/2004 | Byun et al. | |
| 6,806,835 | B2 * | 10/2004 | Iwai et al. | 343/702 |
| 7,102,578 | B2 | 9/2006 | Minemura | |
| 2005/0057409 | A1 | 3/2005 | Choo et al. | |

OTHER PUBLICATIONS

U.S. Appl. No. 60/697,484.

* cited by examiner

*Primary Examiner* — Robert Karacsony

(74) *Attorney, Agent, or Firm* — Abelman, Frayne & Schwab

(57) ABSTRACT

A multi-band antenna including a first antenna portion extending generally in a first plane, a second antenna portion, extending generally in a second plane and a hinged coupling providing coupling between the first antenna portion and the second antenna portion and permitting the second antenna portion to be folded over the first antenna portion such that the first plane and the second plane lie generally parallel.

24 Claims, 22 Drawing Sheets

VIIA
265
270
268
266
284
200
280
267
282
273
272
256
262
236
VIIB

FLAT FOLDING HINGED ANTENNA

REFERENCE TO RELATED APPLICATIONS

The present application is related to U.S. Provisional Patent Application Ser. No. 60/697,484, filed Jul. 8, 2005, and entitled FLAT FOLDING HINGED MULTI-POLE ANTENNA, the disclosure of which is hereby incorporated by reference and priority of which is hereby claimed pursuant to 37 CFR 1.78(a) (4) and (5)(i).

FIELD OF THE INVENTION

The present invention relates to antennas generally and more particularly to folding antennas.

BACKGROUND OF THE INVENTION

The following Patent documents are believed to represent the current state of the art:

U.S. Pat. Nos. 6,680,705 and 5,764,190; and

U.S. Published Patent Application No: 2005/0057409.

SUMMARY OF THE INVENTION

The present invention seeks to provide an improved folding antenna.

There is thus provided in accordance with a preferred embodiment of the present invention a multi-band antenna including a first antenna portion extending generally in a first plane, a second antenna portion, extending generally in a second plane and a hinged coupling providing coupling between the first antenna portion and the second antenna portion and permitting the second antenna portion to be folded over the first antenna portion such that the first plane and the second plane lie generally parallel.

In accordance with a preferred embodiment of the present invention the coupling includes at least one of galvanic coupling and capacitive coupling. Preferably, the first antenna portion includes a strip line antenna. Additionally or alternatively, the second antenna portion includes a wire bent in a generally rectangular shape whose dimensions exceed the dimensions of the first antenna portion.

In accordance with another preferred embodiment of the present invention the second antenna portion is curved with respect to the second plane. Preferably, the second antenna portion includes a curved portion having a curvature diameter which is less than or equal to twice the diameter of the second antenna portion. Additionally or alternatively, the multi-band antenna includes a dual-band antenna, wherein the first antenna portion operates in a high frequency band and the second antenna portion operates in a low frequency band, when coupled to the first antenna portion.

In accordance with yet another preferred embodiment of the present invention the wire includes a first end and a second end, which are arranged generally in a mutually spaced parallel orientation. Preferably, the multi-band antenna includes a tri-band antenna.

In accordance with still another preferred embodiment of the present invention the antenna also includes a pivotable antenna connector coupled to the first antenna portion. Preferably, the pivotable antenna connector is coupled to the first antenna portion by at least one of galvanic coupling and capacitive coupling.

In accordance with a further preferred embodiment of the present invention the antenna is pivotably coupled to a communicating device, whereby the first antenna portion is pivotably coupled to the communicating device about a first axis and the second antenna portion is pivotably coupled to the first antenna portion about a second axis extending perpendicular to the first axis. Preferably, the second antenna portion is folded over the first antenna portion and the first antenna portion lies generally parallel to a side edge of the communicating device, the multi-band antenna has a width which does not exceed a width of the communicating device.

In accordance with yet a further preferred embodiment of the present invention the antenna also includes a third antenna portion coupled to the second antenna portion. Preferably, the third antenna portion is coupled to the second antenna portion by at least one of galvanic coupling and capacitive coupling. Additionally or alternatively, the antenna also includes a hinged coupling providing coupling between the second antenna portion and the third antenna portion and permitting the third antenna portion to be folded over the second antenna portion. Preferably, the hinged coupling provides at least one of galvanic coupling and capacitive coupling.

In accordance with still a further preferred embodiment of the present invention the multi-band antenna includes a quadri-band antenna. Preferably, the multi-band antenna is operative to operate in at least one low frequency band, which is suitable for reception of television broadcasts. Additionally or alternatively, the multi-band antenna is operative to employ second order harmonics thereby to operate in another band.

In accordance with an additional preferred embodiment of the present invention the antenna also includes at least one electrical component operative to provide impedance matching. Preferably, the at least one electrical component includes at least one of an inductor and a capacitor.

In accordance with another preferred embodiment of the present invention the antenna also includes a housing element formed around the first antenna portion. Preferably, the housing element is molded around the first antenna portion. Additionally or alternatively, the antenna also includes a support element operative to support the second antenna portion.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
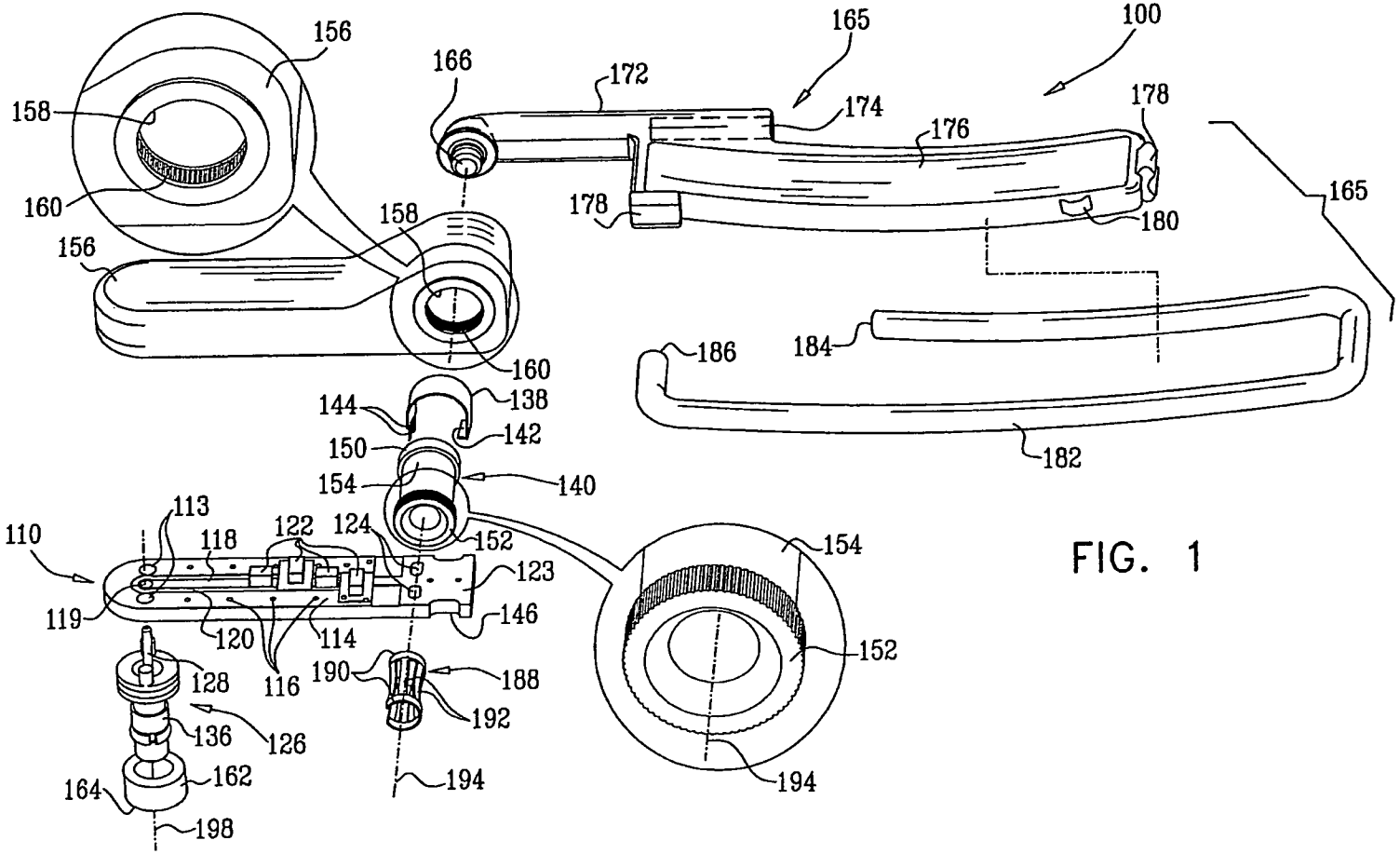
FIG. 1 is a simplified exploded view illustration of an antenna constructed and operative in accordance with a preferred embodiment of the present invention.
Figures 2A, 2B:
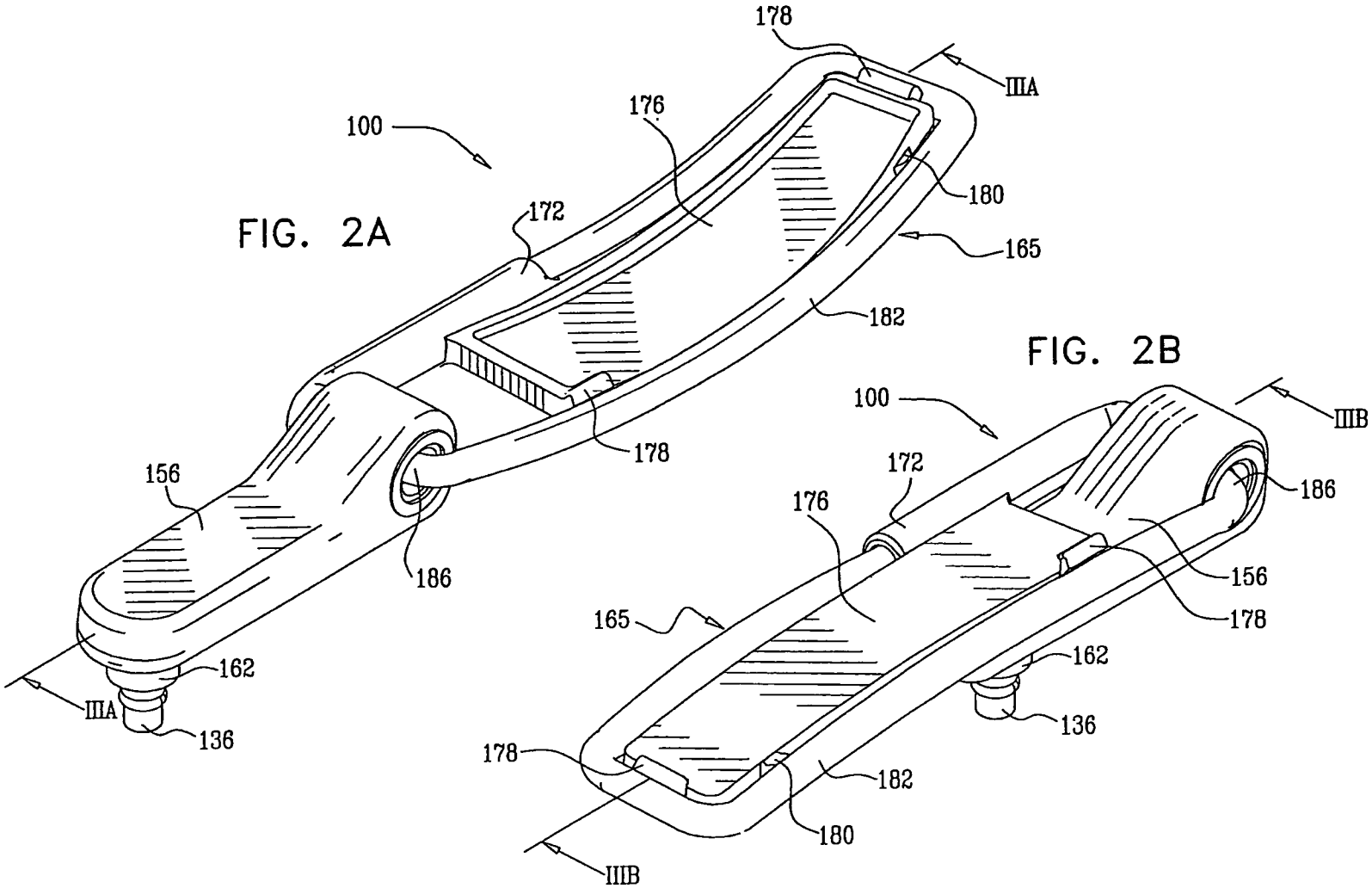
FIGS. 2A and 2B are simplified pictorial illustrations of the antenna of FIG. 1 in two alternative orientations.
Figure 3A:
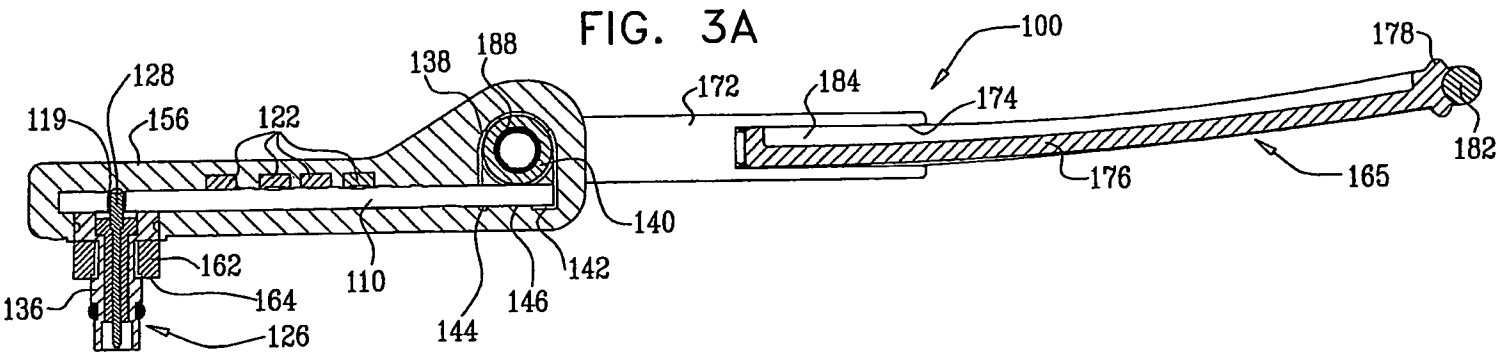
FIGS. 3A and 3B are simplified sectional illustrations of the antenna of FIGS. 1-2B taken along respective section lines and IIIB-IIIB in FIGS. 2A and 2B respectively.
Figure 3B:
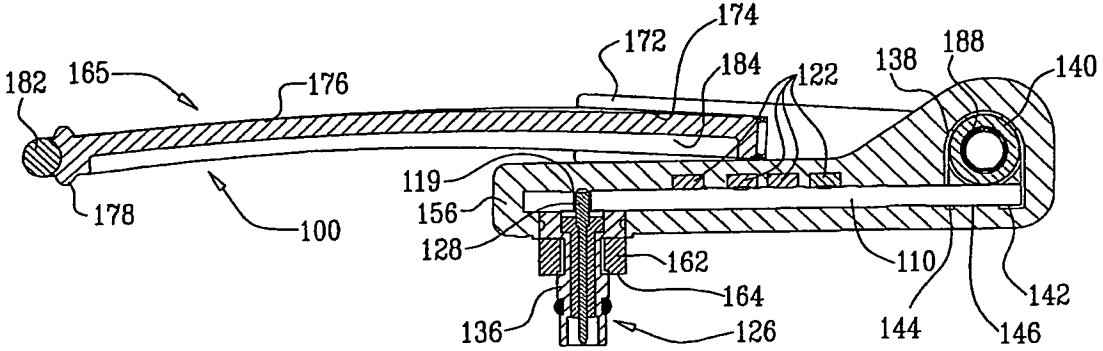

Reference is now made to FIG. 1, which is a simplified exploded view illustration of an antenna 100 constructed and operative in accordance with a preferred embodiment of the present invention, to FIGS. 2A and 2B, which are simplified pictorial illustrations of antenna 100 in two alternative orientations, and to FIGS. 3A and 3B, which are simplified sectional illustrations thereof.

As seen in FIGS. 1-3B, the antenna 100 preferably comprises a printed circuit board 110, which is preferably formed with a plurality of apertures 113, and includes a conductive portion 114 formed with a plurality of vias 116. A strip-line antenna 118, which forms a wave guide which is co-planar with the conductive portion 114 and which has a pin accommodating aperture 119, is separated from conductive portion 114 by a U-shaped insulating portion 120, which preferably is etched out of the circuit board 110. A plurality of components 122, typically four components, which may be passive inductors or capacitors, are mounted onto the printed circuit board 110 to provide impedance matching. A conductive element 123 formed at one end of printed circuit board 110 is preferably formed with a pair of bores 124.

The antenna 100 is formed with an RF connector 126, such as a MMCX plug, commercially available from Amphenol Corporation of Wallington, Conn., USA under catalog designator 908-21106. The connector 126 includes, at a top portion thereof, a conductive pin-tip 128 which extends through pin accommodating aperture 119 and is soldered thereto, and additionally includes a stem portion 136 which is adapted to retain the RF connector 126 in place when inserted in an RF connector socket of a communications card of a mobile device.

A strap 138 preferably connects a cylindrical portion 140 to printed circuit board 110. Strap 138 includes a shoulder portion 142 formed at one end thereof and a pair of prongs 144 formed at another end of the strap 138. Shoulder portion 142 preferably is seated against a bottom surface 146 of conductive element 123, and prongs 144 preferably extend through bores 124 and are soldered to bottom surface 146, thereby preventing movement of cylindrical portion 140 relative to printed circuit board 110. Cylindrical portion 140 includes a first edge portion 150 and a second, externally serrated, edge portion 152, intermediate which is formed a neck portion 154.

A housing element 156, which is preferably dielectric, but alternatively may be formed at least partially of a conductive material, is preferably formed by molding around printed circuit board 110, connector 126 and cylindrical portion 140. Due to the method of molding, the housing element 156 is formed with a transverse bore 158 which accommodates cylindrical portion 140 and which is molded to have a serrated edge surface 160 which corresponds to and interlocks with serrated edge portion 152 of cylindrical portion 140.

As seen with particular clarity in FIGS. 3A and 3B, stem portion 136 extends outwardly of housing element 156, and a portion thereof is protected by a rubber washer 162, which includes a lower transverse surface 164 and which is mounted around the stem portion 136.

Antenna 100 includes a wire assembly 165, which comprises a pivoting pin 166, rotationally held within end 150 of cylindrical portion 140. Pivoting pin 166 is integrally formed with a supporting arm 172 having a bore 174 formed therein. The wire assembly 165 also includes a support surface 176, which is preferably slightly concave but may alternatively be planar. Support surface 176 preferably has mounted thereon a plurality of retaining elements 178 and one or more spacers 180. Support surface 176 may have mounted thereon decorative elements, advertisements or other functional elements. Alternatively, retaining elements 178 and spacers 180 may be mounted on a hollow support frame, which functionally replaces support surface 176.

Also included in wire assembly 165 is a generally rectangular-shaped antenna wire 182, which is preferably slightly concave but may alternatively be planar. The curvature diameter of antenna wire 182 is preferably less than or equal to twice the wire diameter. Preferably, the dimensions of wire 182 exceed those of strip-line antenna 118.

Wire 182 is preferably formed with a first end 184, which is disposed within bore 174 of supporting arm 172, and a second end 186. Second end 186 of wire 182 is preferably rotatably maintained within cylindrical portion 140 by a generally cylindrical spring element 188. Spring element 188 preferably includes edge portions 190, intermediate which are formed a plurality of resilient supporting ribs 192.

Wire 182 generally surrounds support surface 176 at a fixed distance therefrom. The distance between the wire 182 and support surface 176 is maintained by spacers 180, and the fixed orientation therebetween is retained by retaining elements 178.

Rotation of the wire assembly 165 with respect to housing element 156 is enabled by rotation of pivoting pin 166 within cylindrical portion 140, and corresponding rotation of second end 186 of wire 182 with respect to spring element 188. It is appreciated that rotation of pivoting pin 166 and of second end 186 results in rotation of the entire wire assembly 165 about an axis 194 extending longitudinally through cylindrical portion 140. It is appreciated that the rotation of wire assembly 165 enables the antenna 100 to assume either one of the alternative orientations shown in FIGS. 2A and 2B as well as a variety of intermediate orientations.

Wire 182 of wire assembly 165 is preferably galvanically coupled to strip-line antenna 118, but may alternatively be non-galvanically coupled thereto, as by capacitive coupling.

As seen with particular clarity in FIGS. 3A and 3B, the wire assembly 165 is not coplanar with printed circuit board 110, due to the placement of cylindrical portion 140 above the printed circuit board 110. Due to this arrangement of cylindrical portion 140 and printed circuit board 110, the pivot axis 194 is raised with respect to the top surface of printed circuit board 110.

As seen with particular clarity in FIGS. 2B and 3B, the concavity of wire assembly 165 allows it to overbend with respect to housing element 156. This design feature, together with pivot axis 194 being raised above printed circuit board 110 with the length and dimensions of supporting arm 172, permits a compact antenna configuration as shown hereinbelow with reference to FIGS. 4A-4C.

Figure 4A:
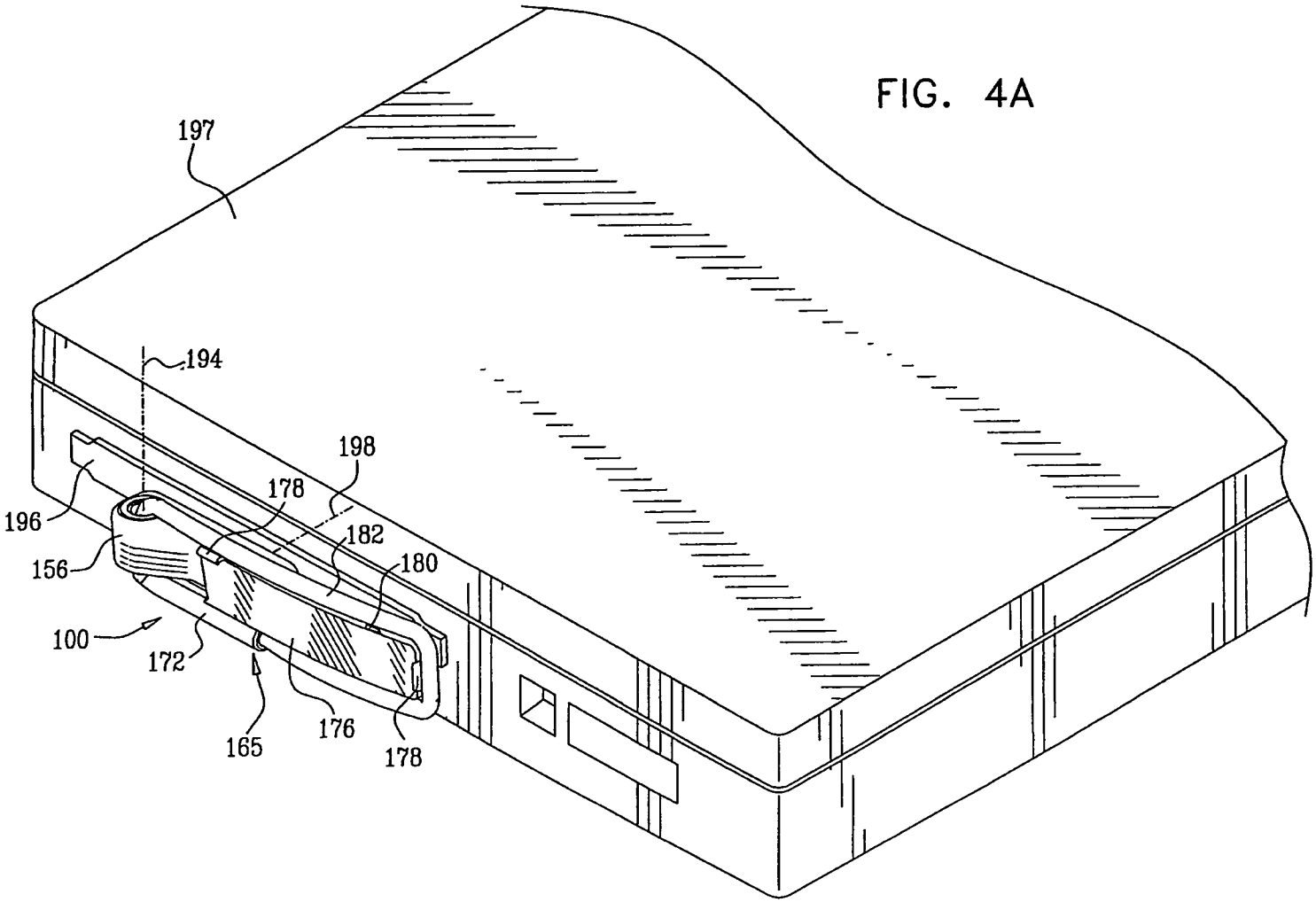
FIGS. 4A, 4B and 4C are simplified diagrammatic illustrations of the antenna of FIGS. 1-3B assembled onto a communications element which is usable in a mobile device, in three alternative orientations.
Figure 4B:
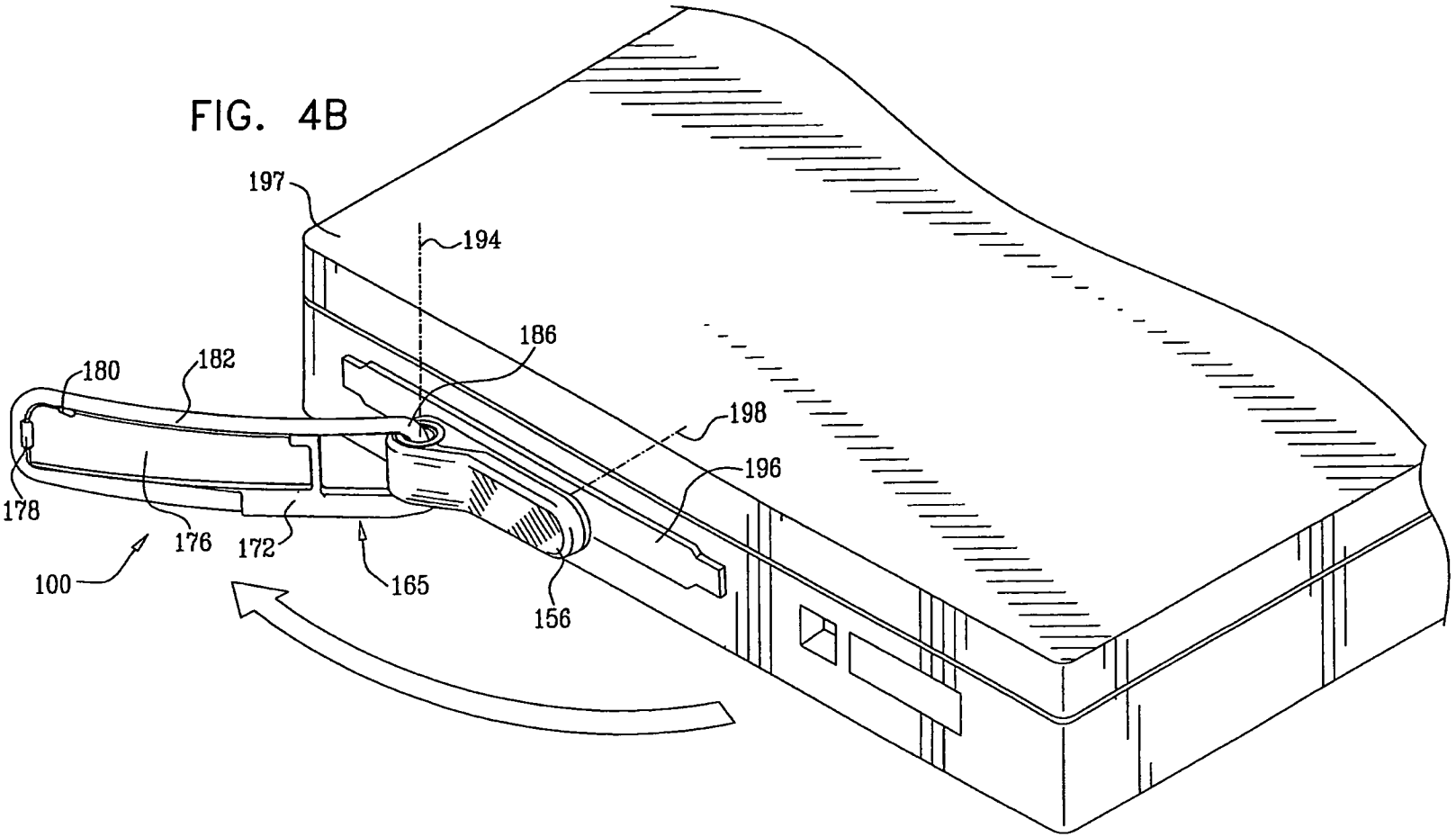
Figure 4C:
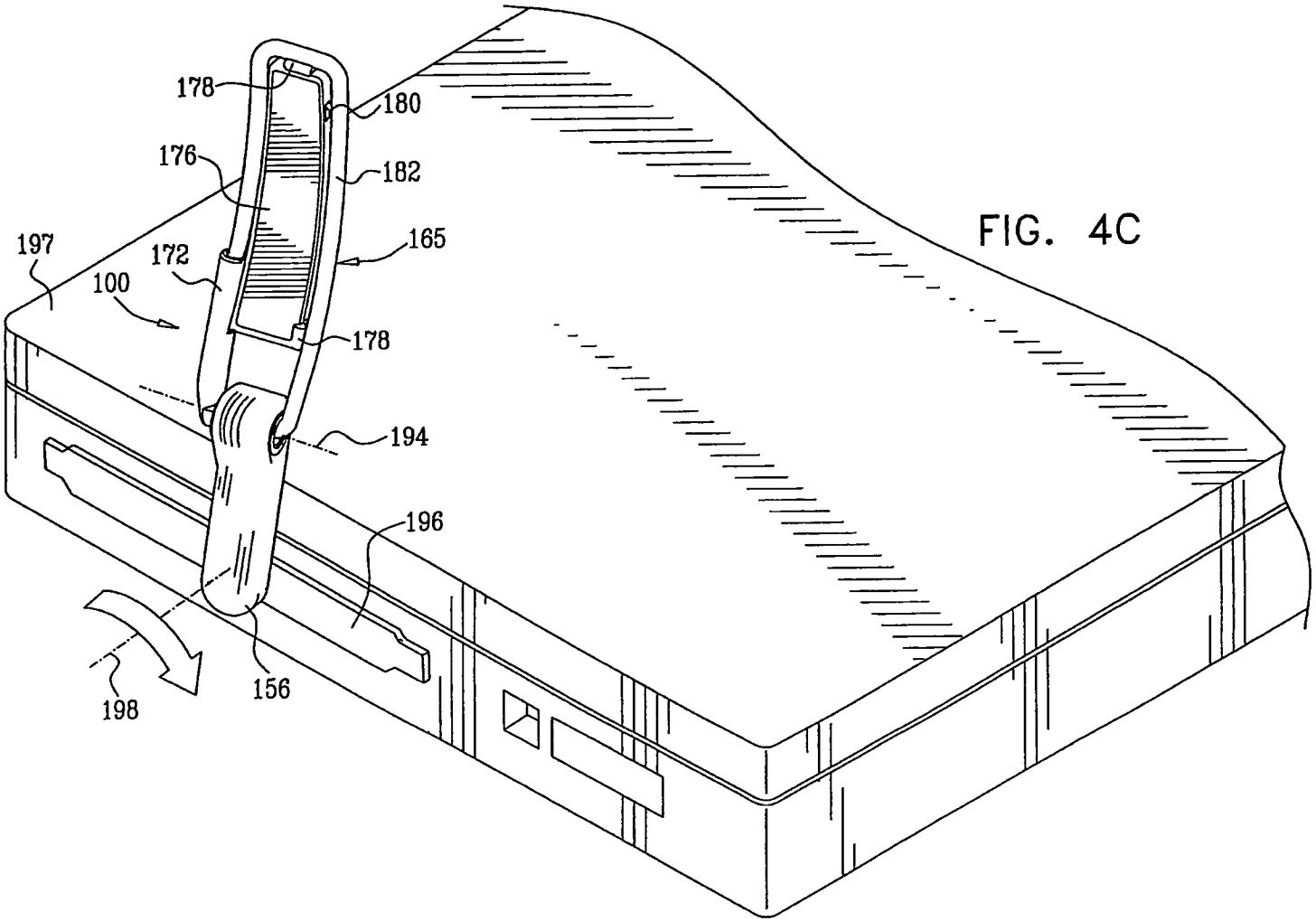

Reference is now additionally made to FIGS. 4A, 4B and 4C, which are simplified diagrammatic illustrations of the antenna 100 assembled onto a communications element placed in a mobile device, in three alternative orientations. As seen in FIGS. 4A-4C, stem portion 136 (FIGS. 1-3B) is preferably rotatably accommodated within a suitable RF connector socket formed in a communications element 196, such as a PCMCIA card or a PC express card, placed in a mobile device 197, such as a portable computer or a PDA. This arrangement enables the antenna 100 to pivot about an axis 198 which extends longitudinally through connector 126 and is generally perpendicular to axis 194. Alternatively, the stem portion 136 may be inserted directly into an RF connector socket formed in the mobile device 197.

Turning specifically to FIG. 4A, the antenna 100 is seen lying generally parallel to a side of the communications element 196, and having the wire assembly 165 folded onto housing element 156, such that the plane of wire assembly 165 lies generally parallel to the housing element 156. This orientation is particularly suitable for compact storage of antenna 100 while allowing antenna 100 limited functionality as a transmitter and/or receiver. It is appreciated that in the orientation shown in FIG. 4A, the width of the antenna 100 does not exceed that of the mobile device 197, thereby enabling compact storage thereof.

FIG. 4B illustrates the antenna 100 lying generally parallel to a side of the communications element 196, and having the wire assembly 165 extending alongside housing element 156. Rotation of wire assembly 165 about axis 194, indicated by an arrow in FIG. 4B, changes the orientation of antenna 100 from that shown in FIG. 4A to this orientation.

Turning to FIG. 4C, it is seen that antenna 100 is in a generally perpendicular orientation with respect to communications element 196. Rotation of antenna 100 about axis 198, as indicated by an arrow in FIG. 4C, changes the orientation of antenna 100 from that shown in FIG. 4B to this orientation. It is appreciated that in this orientation wire assembly 165 extends away from mobile device 197, thereby providing optimal antenna reception.

It is appreciated that the wire assembly 165 may assume any other orientation within the limits shown in FIGS. 2A and 2B, and that the antenna 100 may be positioned at any rotational angle with respect to communications element 196.

It is a particular feature of the present invention that the antenna 100 provides dual band functionality. A first band, which is typically a low frequency band, is affected by the length, width and concavity of wire 182. A second band, which is typically a high frequency band, is affected by the length and/or width of strip line antenna 118, with some lesser tuning contribution stemming from galvanic and near field RF coupling between the wire assembly 165 and housing element 156.

Figure 5:
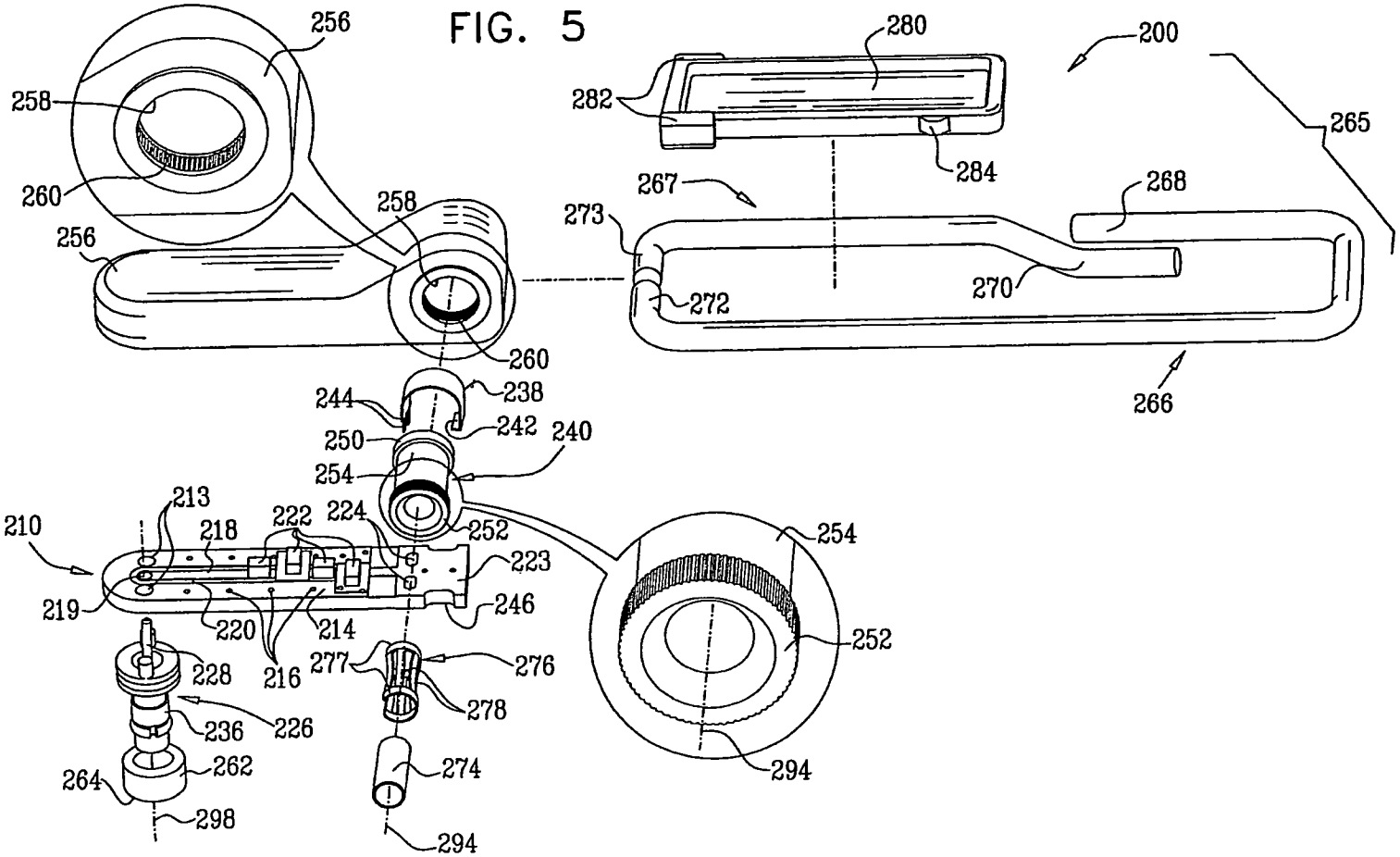
FIG. 5 is a simplified exploded view illustration of an antenna constructed and operative in accordance with another preferred embodiment of the present invention.
Figures 6A, 6B:
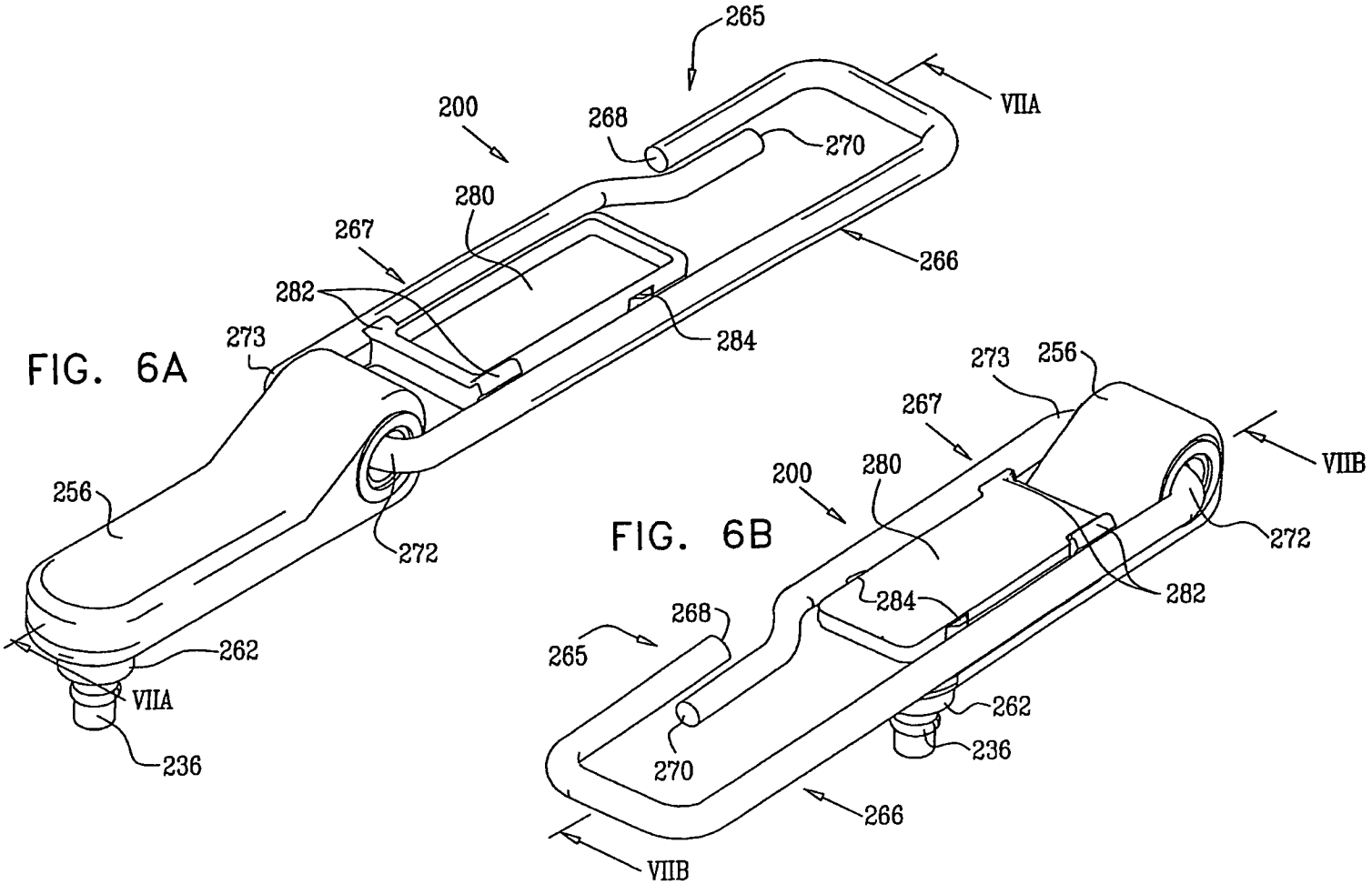
FIGS. 6A and 6B are simplified pictorial illustrations of the antenna of FIG. 5 in two alternative orientations.
Figure 7A:
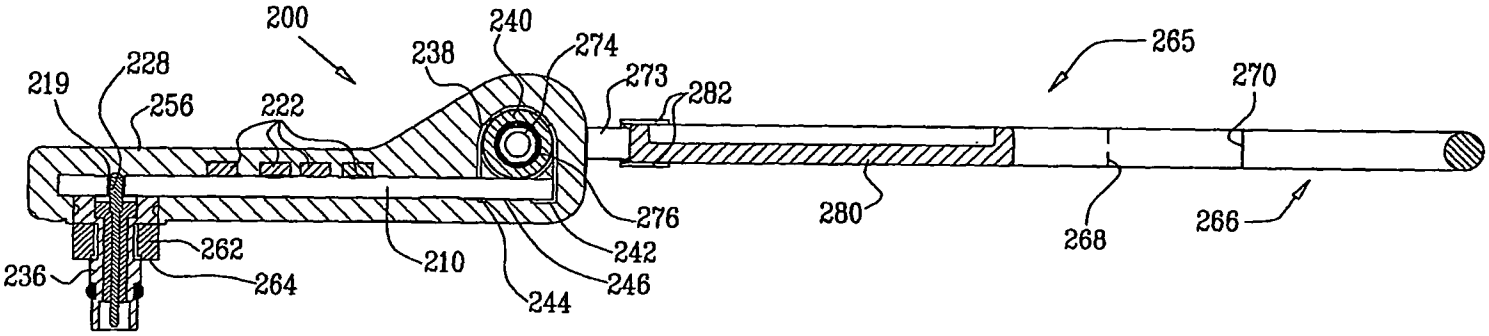
FIGS. 7A and 7B are simplified sectional illustrations of the antenna of FIGS. 5-6B taken along respective section lines VIIA-VIIA and VIIB-VIIB in FIGS. 6A and 6B respectively.
Figure 7B:
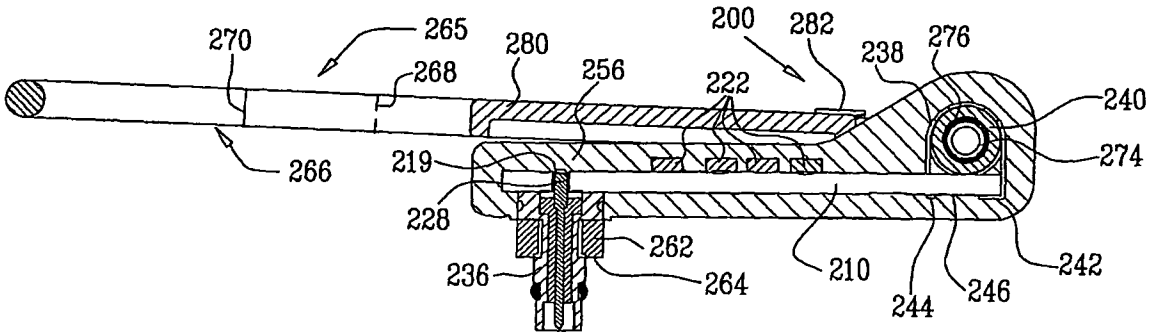

Reference is now made to FIG. 5, which is a simplified exploded view illustration of an antenna 200 constructed and operative in accordance with another preferred embodiment of the present invention, to FIGS. 6A and 6B, which are simplified pictorial illustrations of antenna 200 in two alternative orientations, and to FIGS. 7A and 7B, which are simplified sectional illustrations thereof.

As seen in FIGS. 5-7B, the antenna 200 preferably comprises a printed circuit board 210, which is preferably formed with a plurality of apertures 213, and includes a conductive ground portion 214 formed with a plurality of vias 216. A strip-line antenna 218 which forms a waveguide which is co-planar with the conductive portion 214 and which has a pin accommodating aperture 219 formed therein, is separated from conductive portion 214 by a U-shaped insulating portion 220 which preferably is etched out of the circuit board 210. A plurality of components 222, typically four components, which may be passive inductors or capacitors, are mounted onto the printed circuit board 210 to provide impedance matching. A conductive element 223 formed at one end of printed circuit board 210 is preferably formed with a pair of bores 224.

The antenna 200 is formed with an RF connector 226, such as a MMCX plug, commercially available from Amphenol Corporation of Wallington, Conn., USA under catalog designator 908-21106. The connector 226 includes, at a top portion thereof, a conductive pin-tip 228, which extends through pin accommodating aperture 219 and is soldered thereto, and additionally includes a stem portion 236 which is adapted to retain the RF connector 226 in place when inserted in an RF connector socket of a communications card of a mobile device.

A strap 238 preferably connects a cylindrical portion 240 to printed circuit board 210. Strap 238 includes a shoulder portion 242 formed at one end thereof and a pair of prongs 244 formed at another end of the strap 238. Shoulder portion 242 preferably is seated against a bottom surface 246 of conductive element 223, and prongs 244 preferably extend through bores 224 and are soldered to bottom surface 246, thereby preventing movement of cylindrical portion 240 relative to printed circuit board 210. Cylindrical portion 240 includes a first edge portion 250 and a second, externally serrated, edge portion 252, intermediate which is formed a neck portion 254.

A housing element 256, which is preferably dielectric, but alternatively may be formed at least partially of a conductive material, is preferably formed by molding around printed circuit board 210, connector 226 and cylindrical portion 240. Due to the method of molding, the housing element 256 is formed with a transverse bore 258 which accommodates cylindrical portion 240 and which is molded to have a serrated edge surface 260 which corresponds to and interlocks with serrated edge portion 252 of cylindrical portion 240.

As seen with particular clarity in FIGS. 7A and 7B, stem portion 236 extends outwardly of housing element 256, and a portion thereof is protected by a rubber washer 262, which includes a lower transverse surface 264 and which is mounted around the stem portion 236.

Antenna 200 includes a wire assembly 265, which comprises a pair of antenna wire portions 266 and 267, together forming a generally rectangular-shaped antenna, having ends 268 and 270 respectively. Wire ends 268 and 270 are preferably arranged in a mutually spaced parallel orientation. Preferably, the dimensions of the rectangular antenna exceed those of strip-line antenna 218.

Wire portions 266 and 267 preferably also each include a pivoting portion, referenced by numerals 272 and 273 respectively, which are held together by a conductive interface tube 274. Interface tube 274 is rotatably maintained within cylindrical portion 240 by a generally cylindrical spring element 276. Spring element 276 preferably includes edge portions 277, intermediate which are formed a plurality of resilient supporting ribs 278.

Wire portions 266 and 267 are preferably formed around and are spaced from a support surface 280 via a plurality of retaining elements 282 and one or more spacers 284 which are mounted on support surface 280. Support surface 280 may have mounted thereon decorative elements, advertisements or other functional elements. Alternatively, retaining elements 282 and spacers 284 may be mounted on a hollow support frame, which functionally replaces support surface 280.

Rotation of the wire assembly 265 with respect to housing element 256 is enabled by rotation of interface tube 274 and pivoting portion 272 and 273 with respect to spring element 276 within cylindrical portion 240. It is appreciated that rotation of interface tube 274 and pivoting portions 272 and 273 results in rotation of the entire wire assembly 265 about an axis 294 extending longitudinally through cylindrical portion 240. It is appreciated that the rotation of wire assembly 265 enables the antenna 200 to assume either one of the alternative orientations shown in FIGS. 6A and 6B as well as a variety of intermediate orientations.

Wire portions 266 and 267 of wire assembly 265 are preferably galvanically coupled to strip-line antenna 218, but may alternatively be non-galvanically coupled thereto, as by capacitive coupling.

As seen with particular clarity in FIGS. 7A and 7B, the wire assembly 265 is not coplanar with printed circuit board 210, due to the placement of cylindrical portion 240 above the printed circuit board 210. Due to this arrangement of cylindrical portion 240 and printed circuit board 210, the pivot axis 294 is raised with respect to the top surface of printed circuit board 210.

Figure 8A:
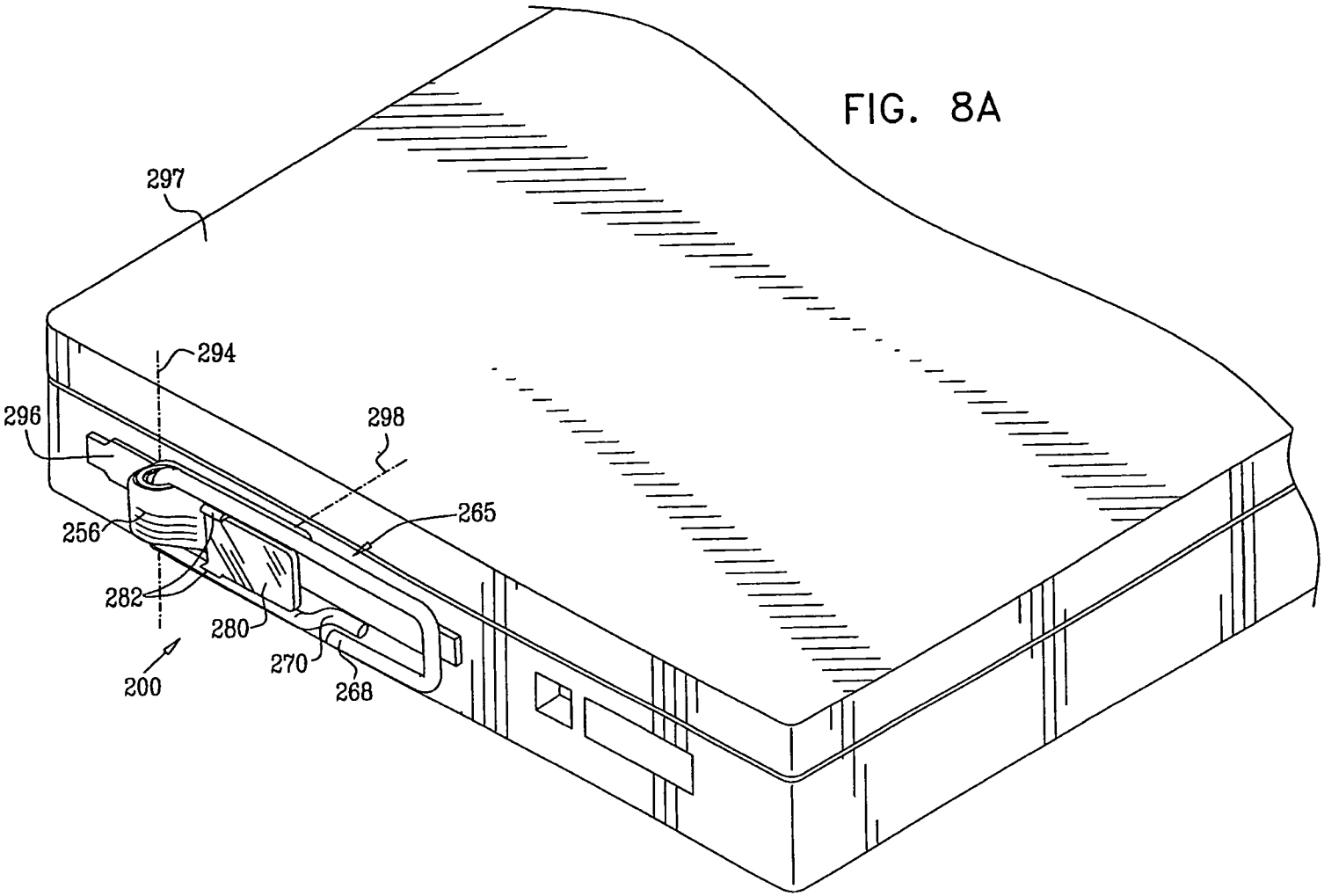
FIGS. 8A, 8B and 8C are simplified diagrammatic illustrations of the antenna of FIGS. 5-7B assembled onto a communications element which is usable in a mobile device, in three alternative orientations.
Figure 8B:
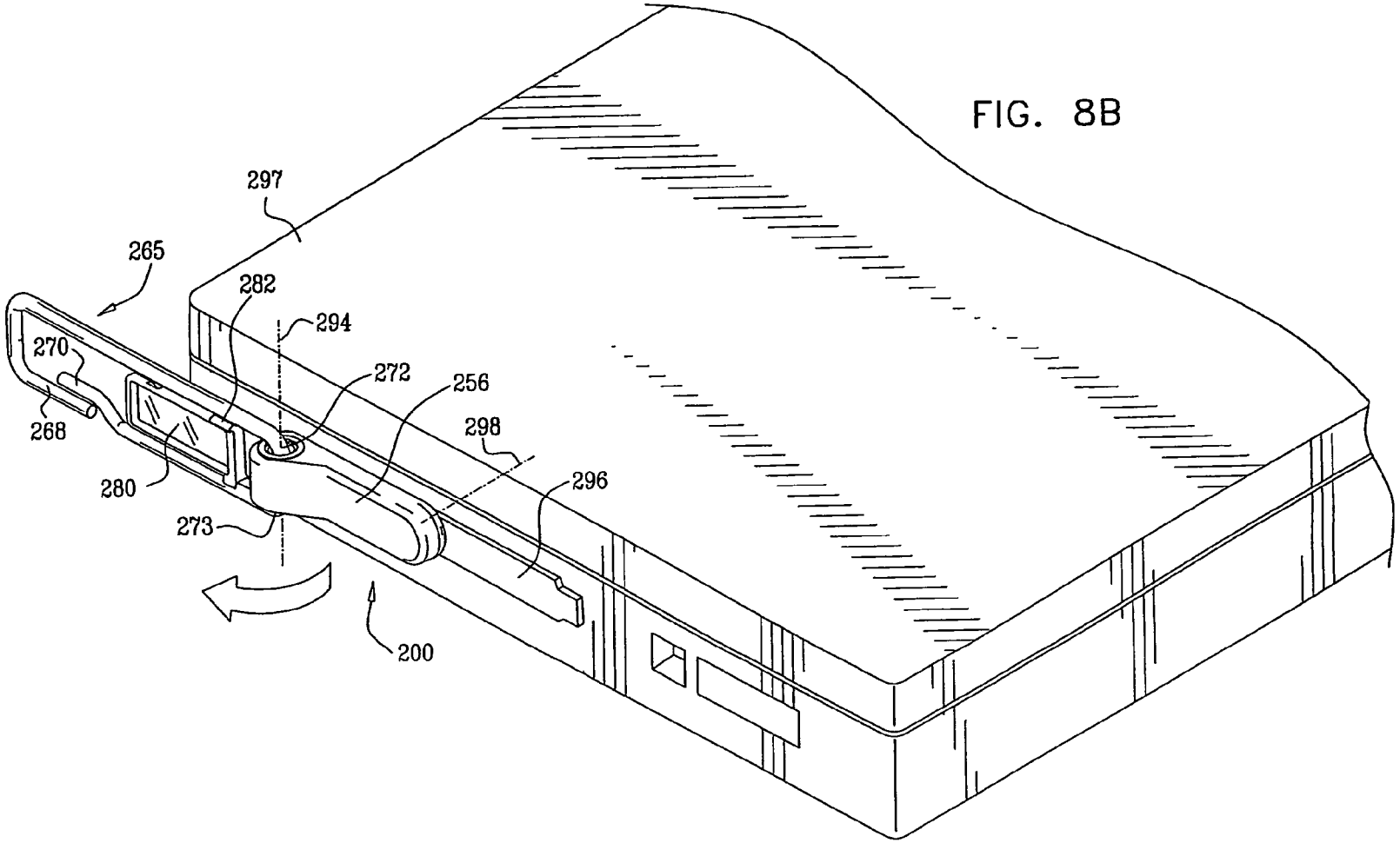
Figure 8C:
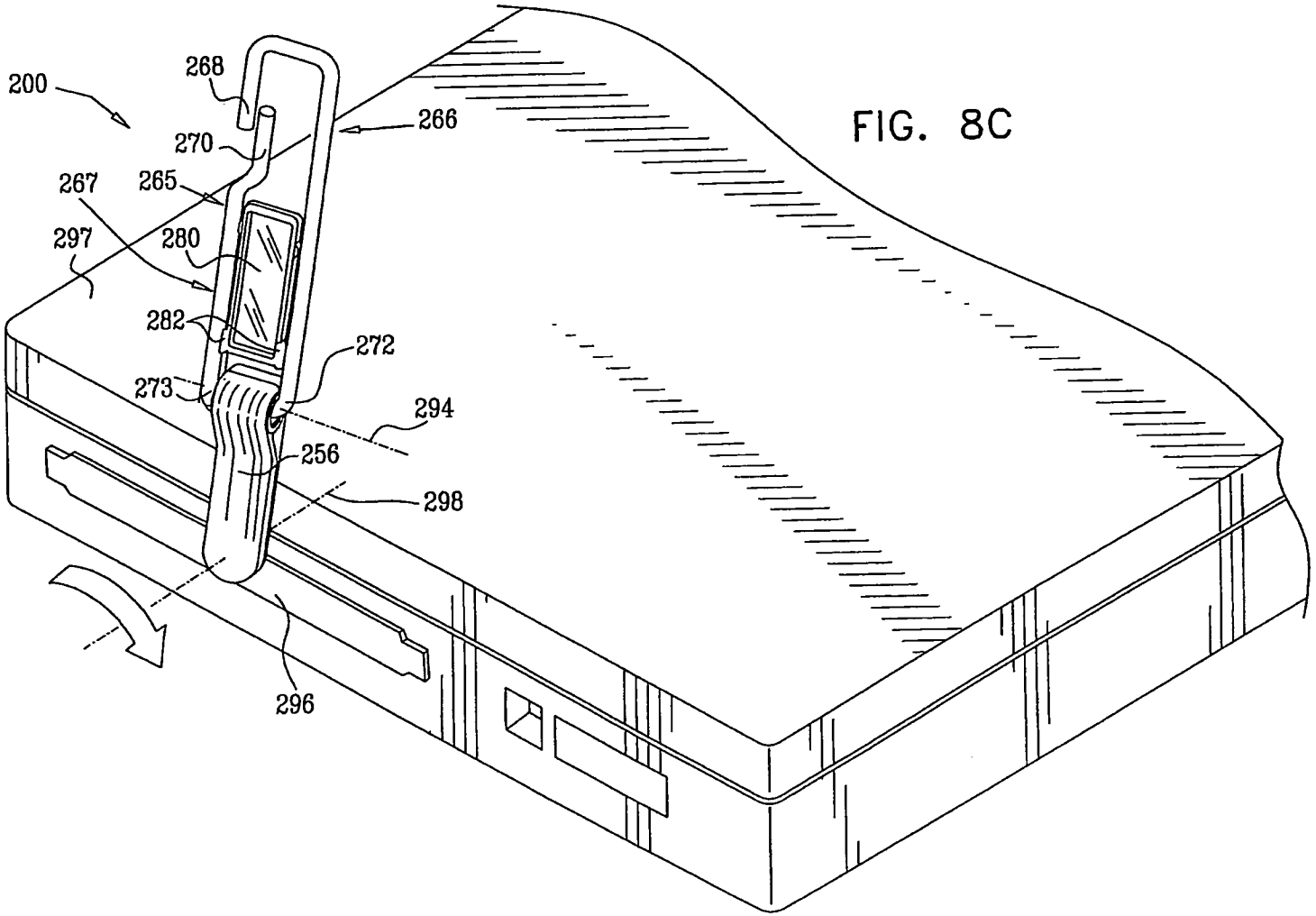

Reference is now additionally made to FIGS. 8A, 8B and 8C, which are simplified diagrammatic illustrations of the antenna 200 assembled onto a communications element placed in a mobile device, in three alternative orientations. As seen in FIGS. 8A-8C, stem portion 236 (FIGS. 5-7B) is preferably rotatably accommodated within a suitable RF connector socket formed in a communications element 296, such as a PCMCIA card or a PC express card, placed in a mobile device 297, such as a portable computer or a PDA. This arrangement enables the antenna 200 to pivot about an axis 298 which extends longitudinally through connector 226 and is generally perpendicular to axis 294. Alternatively, the stem portion 236 may be inserted directly into an RF connector socket formed in the mobile device 297.

Turning specifically to FIG. 8A, the antenna 200 is seen lying generally parallel to a side of the communications element 296, and having the wire assembly 265 folded onto housing element 256, such that the plane of wire assembly 265 lies generally parallel to the housing element 256. This orientation is particularly suitable for compact storage of antenna 200 while allowing antenna 200 limited functionality as a transmitter and/or receiver. It is appreciated that in the orientation shown in FIG. 8A, the width of the antenna 200 does not exceed that of the mobile device 297, thereby enabling compact storage thereof.

FIG. 8B illustrates the antenna 200 lying generally parallel to a side of the communications element 296, and having the wire assembly 265 extending alongside housing element 256. Rotation of wire assembly 265 about axis 294, indicated by an arrow in FIG. 8B, changes the orientation of antenna 200 from that shown in FIG. 8A to this orientation.

Turning to FIG. 8C, it is seen that antenna 200 is in a generally perpendicular orientation with respect to communications element 296. Rotation of antenna 200 about axis 298, as indicated by an arrow in FIG. 8C, changes the orientation of antenna 200 from that shown in FIG. 8B to this orientation. It is appreciated that in this orientation wire assembly 265 extends away from mobile device 297, thereby providing optimal antenna reception.

It is appreciated that the wire assembly 265 may assume any other orientation within the limits shown in FIGS. 6A and 6B, and that the antenna 200 may be positioned at any rotational angle with respect to communications element 296.

It is a particular feature of the present invention that the antenna 200 is a multi-element antenna which provides tri-band functionality. First and second bands, which are typically a low frequency band and a high frequency band respectively, are affected by the length, width and mutual orientation of ends 268 and 270 of wire portions 266 and 267. A third band, which is typically another high frequency band, is affected by the length and/or width of strip line antenna 218, with some lesser tuning contribution stemming from galvanic and near field RF coupling between the wire assembly 265 and housing element 256.

Figure 9:
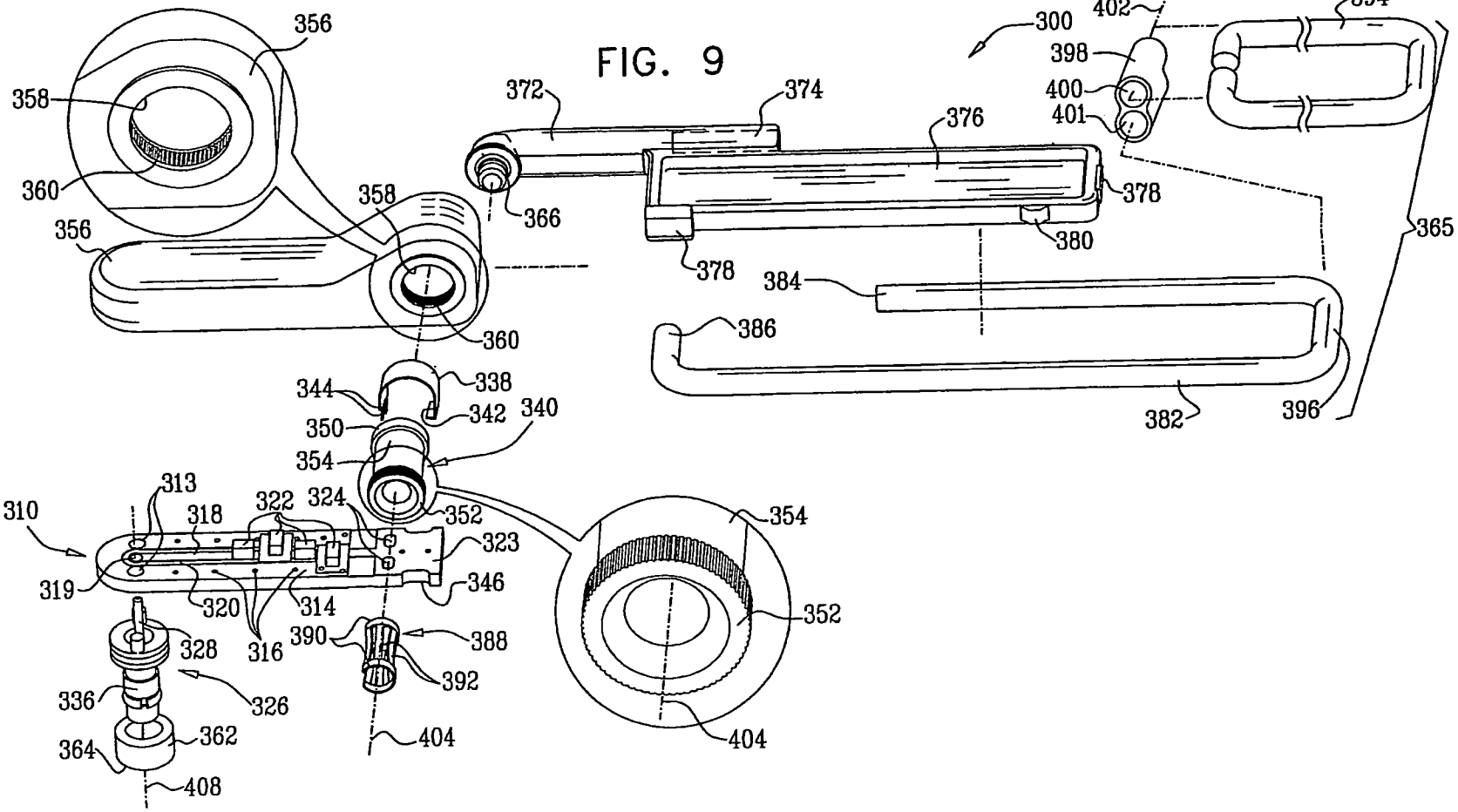
FIG. 9 is a simplified exploded view illustration of an antenna constructed and operative in accordance with yet another preferred embodiment of the present invention.
Figure 10A:
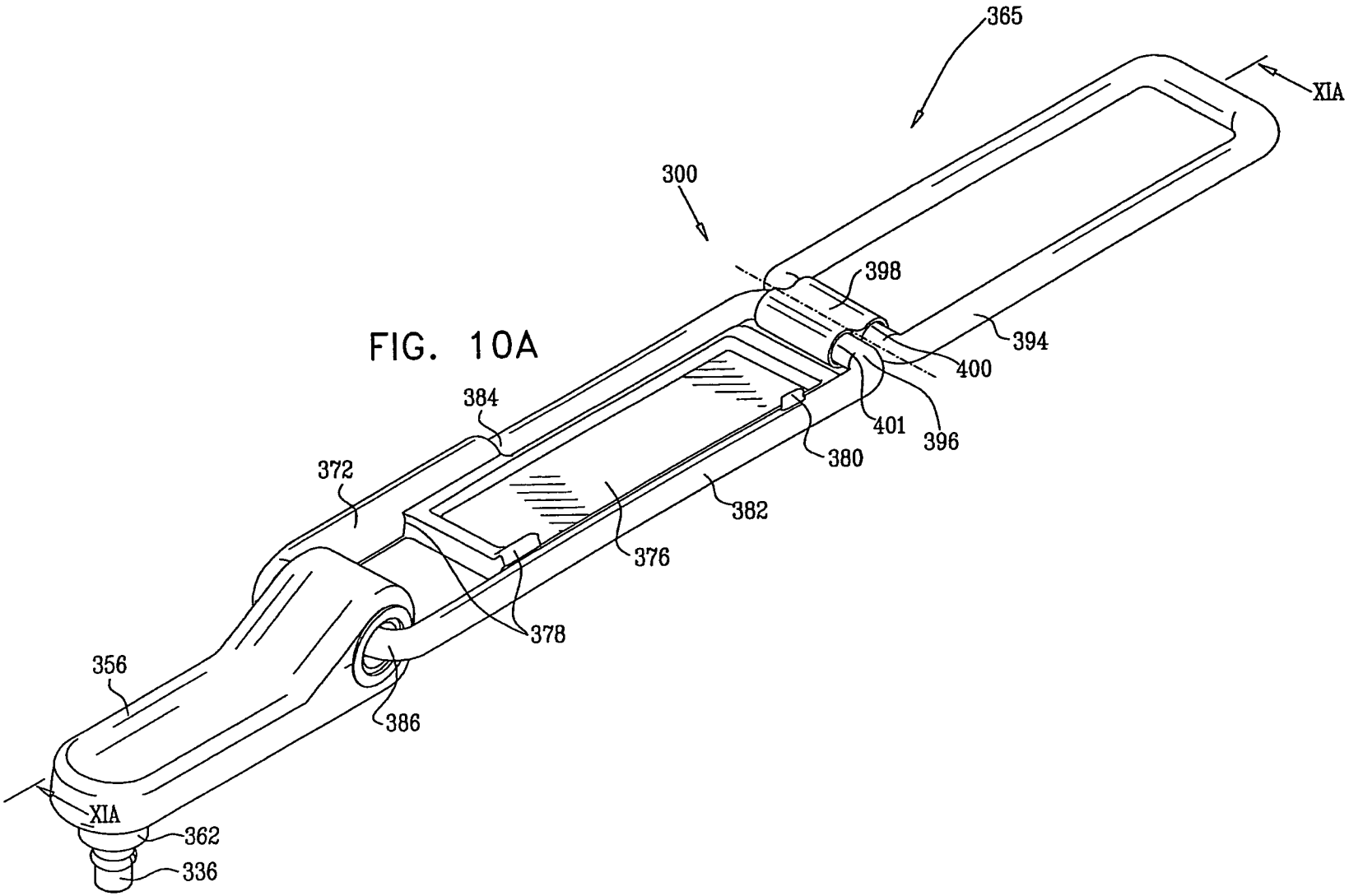
FIGS. 10A, 10B and 10C are simplified pictorial illustrations of the antenna of FIG. 9 in three alternative orientations.
Figure 10B:
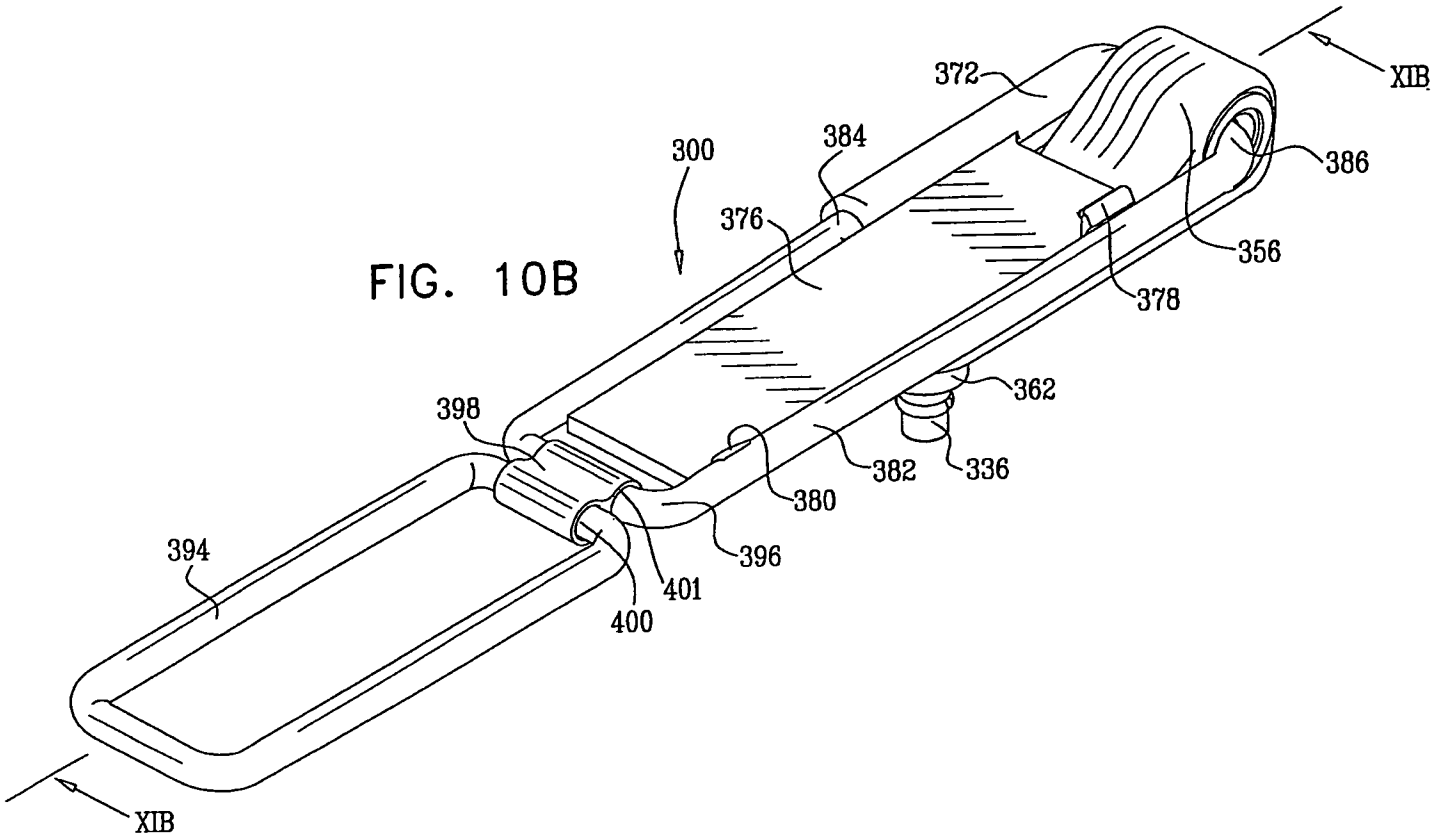
Figure 10C:
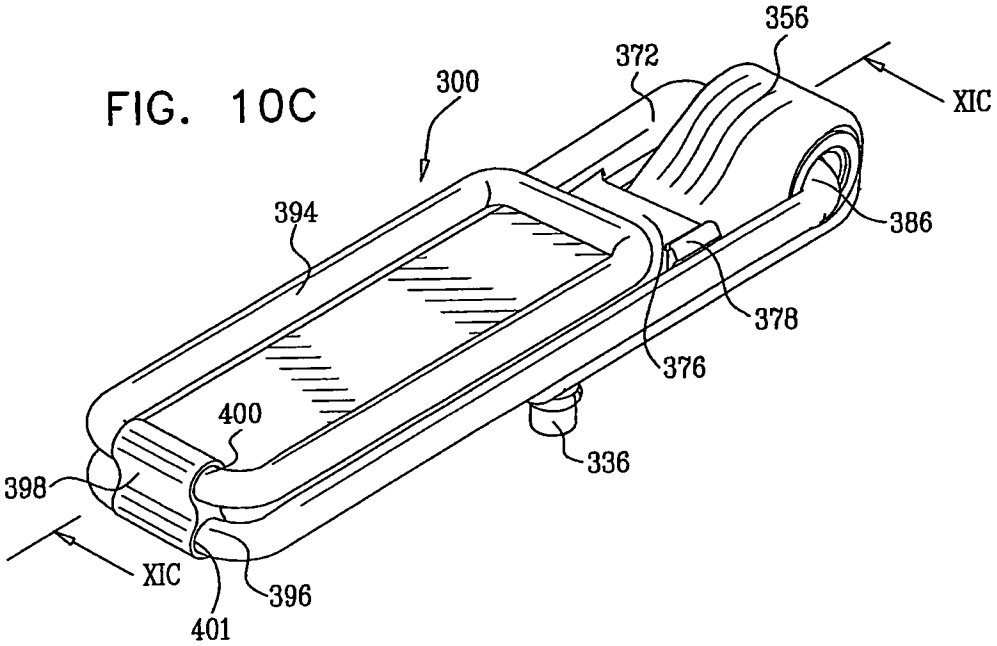
Figure 11A:
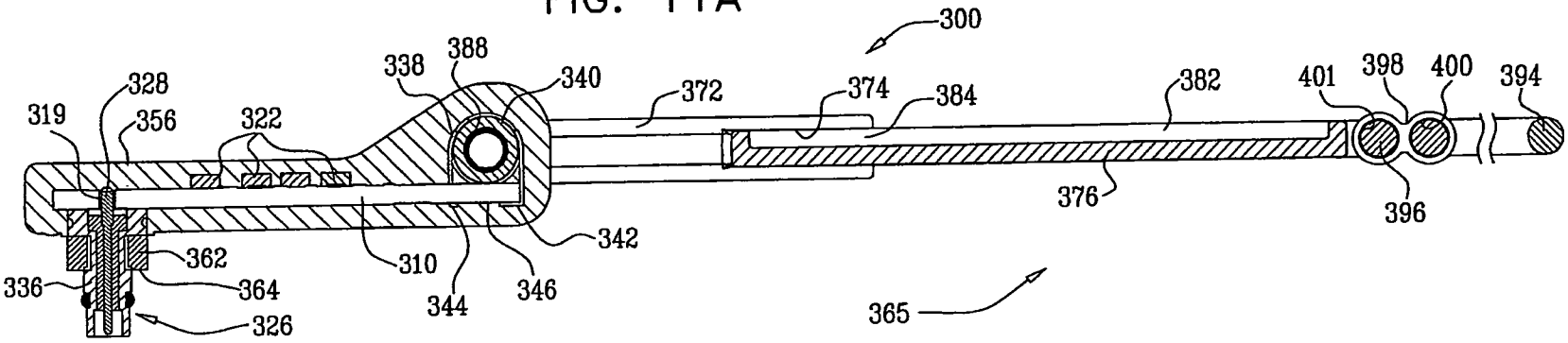
FIGS. 11A, 11B and 11C are simplified sectional illustrations of the antenna of FIGS. 9-10B taken along respective section lines XIA-XIA, XIB-XIB and XIC-XIC in FIGS. 10A, 10B and 10C respectively.
Figure 11B:
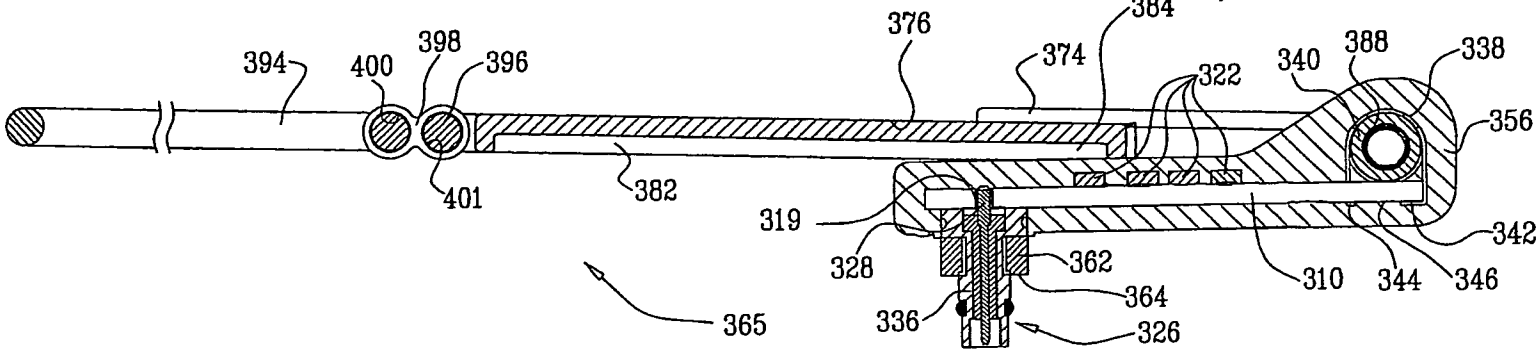
Figure 11C:
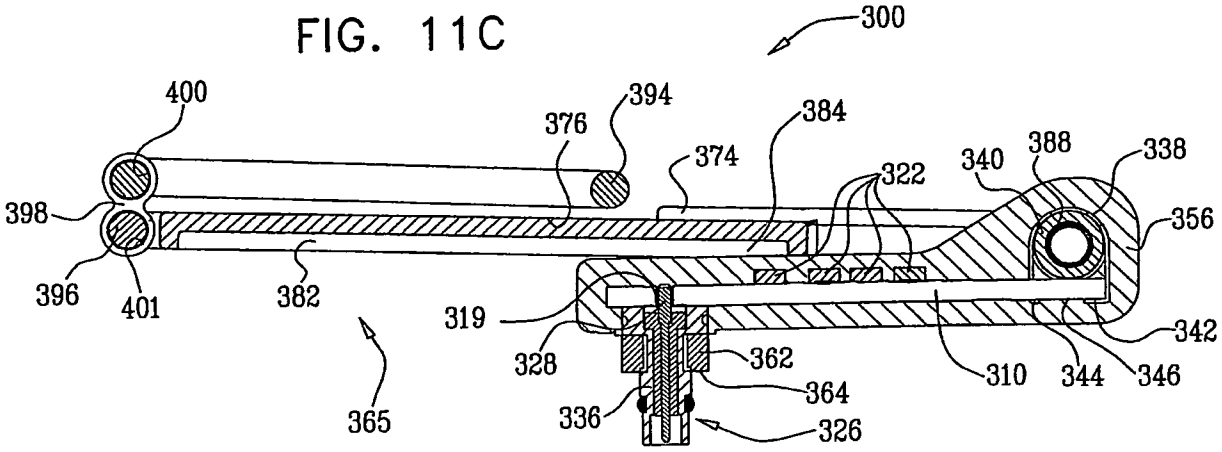

Reference is now made to FIG. 9, which is a simplified exploded view illustration of an antenna 300 constructed and operative in accordance with a preferred embodiment of the present invention, to FIGS. 10A, 10B and 10C, which are simplified pictorial illustrations of antenna 300 in three alternative orientations, and to FIGS. 11A, 11B and 11C, which are simplified sectional illustrations thereof. As described hereinbelow, antenna 300 is a double-hinged antenna.

As seen in FIGS. 9-11C, the antenna 300 preferably comprises a printed circuit board 310, which is preferably formed with a plurality of apertures 313, and includes a conductive portion 314 formed with a plurality of vias 316. A strip-line antenna 318, which forms a wave guide which is co-planar with the conductive portion 314 and which has a pin accommodating aperture 319 formed therein, is separated from conductive portion 314 by a U-shaped insulating portion 320, which preferably is etched out of the circuit board 310. A plurality of components 322, typically four components, which may be passive inductors or capacitors, are mounted onto the printed circuit board 310 to provide impedance matching. A conductive element 323 formed at one end of printed circuit board 310 is preferably formed with a pair of bores 324.

The antenna 300 is formed with an RF connector 326, such as a MMCX plug, commercially available from Amphenol Corporation of Wallington, Conn., USA under catalog designator 908-21106. The connector 326 includes, at a top portion thereof, a conductive pin-tip 328 which extends through pin accommodating aperture 319 and is soldered thereto, and additionally includes a stem portion 336 which is adapted to retain the RF connector 326 in place when inserted in an RF connector socket of a communications card of a mobile device.

A strap 338 preferably connects a cylindrical portion 340 to printed circuit board 310. Strap 338 includes a shoulder portion 342 formed at one end thereof and a pair of prongs 344 formed at another end of the strap 338. Shoulder portion 342 preferably is seated against a bottom surface 346 of conductive element 323, and prongs 344 preferably extend through bores 324 and are soldered to bottom surface 346, thereby preventing movement of cylindrical portion 340 relative to printed circuit board 310. Cylindrical portion 340 includes a first edge portion 350 and a second, externally serrated, edge portion 352, intermediate which is formed a neck portion 354.

A housing element 356, which is preferably dielectric, but alternatively may be formed at least partially of a conductive material, is preferably formed by molding around printed circuit board 310, connector 326 and cylindrical portion 340. Due to the method of molding, the housing element 356 is formed with a transverse bore 358 which accommodates cylindrical portion 340 and which is molded to have a serrated edge surface 360 which corresponds to and interlocks with serrated edge portion 352 of cylindrical portion 340.

As seen with particular clarity in FIGS. 11A-11C, stem portion 336 extends outwardly of housing element 356, and a portion thereof is protected by a rubber washer 362, which includes a lower transverse surface 364 and which is mounted around the stem portion 336.

Antenna 300 includes a wire assembly 365, which comprises a pivoting pin 366, rotationally held within end 350 of cylindrical portion 340. Pivoting pin 366 is integrally formed with a supporting arm 372 having a bore 374 formed therein. The wire assembly 365 also includes a support surface 376. Support surface 376 preferably has mounted thereon one or more retaining elements 378 and one or more spacers 380. Support surface 376 may have mounted thereon decorative elements, advertisements or other functional elements. Alternatively, retaining elements 378 and spacers 380 may be mounted on a hollow support frame, which functionally replaces support surface 376.

Also included in wire assembly 365 is a generally rectangular-shaped antenna wire 382, which is preferably formed with a first end 384, which is disposed within bore 374 of supporting arm 372, and a second end 386. Second end 386 of wire 382 is preferably rotatably maintained within cylindrical portion 340 by a generally cylindrical spring element 388. Spring element 388 preferably includes edge portions 390, intermediate which are formed a plurality of resilient supporting ribs 392. Preferably, the dimensions of wire 382 exceed those of strip-line antenna 318.

Wire 382 generally surrounds support surface 376 at a fixed distance therefrom. The distance between the wire 382 and support surface 376 is maintained by spacers 380, and the fixed orientation therebetween is retained by retaining elements 378.

A second wire portion 394, which is preferably generally rectangular, is preferably connected to a transverse portion 396 of wire 382 via a connector 398 which is formed with a pair of bores 400 and 401. Preferably, second wire portion 394 is seated in bore 400 and transverse portion 396 of wire 382 is seated in bore 401. Second wire portion 394 may rotate about an axis 402 extending longitudinally through connector 398, thereby to extend the wire assembly 365.

Rotation of the wire assembly 365 with respect to housing element 356 is enabled by rotation of pivoting pin 366 within cylindrical portion 340, and corresponding rotation of second end 386 of wire 382 with respect to spring element 388. It is appreciated that rotation of pivoting pin 366 and of second end 386 results in rotation of the entire wire assembly 365 about an axis 404 extending longitudinally through cylindrical portion 340. It is appreciated that the rotation of wire assembly 365 and of second wire portion 394 enables the antenna 300 to assume any of the orientations shown in FIGS. 10A, 10B and 10C as well as a variety of intermediate orientations.

Wire 382 of wire assembly 365 is preferably galvanically coupled to strip-line antenna 318, but may alternatively be non-galvanically coupled thereto, as by capacitive coupling. Additionally, wire portion 394 is preferably galvanically coupled to wire portion 382, but may alternatively be non-galvanically coupled thereto, as by capacitive coupling.

Reference is now additionally made to FIGS. 12A, 12B, 12C and 12D, which are simplified diagrammatic illustrations of the antenna 300 assembled onto a communications element placed in a mobile device, in four alternative orientations. As seen in FIGS. 12A-12D, stem portion 336 (FIGS. 9-11C) is preferably rotatably accommodated within a suitable RF connector socket formed in a' communications element 406, such as a PCMCIA card or a PC express card, placed in a mobile device 407, such as a portable computer or a PDA. This arrangement enables the antenna 300 to pivot about axis 408 which extends longitudinally through connector 326 and is generally perpendicular to axis 404. Alternatively, the stem portion 336 may be inserted directly into an RF connector socket formed in, the mobile device 407.

Figure 12A:
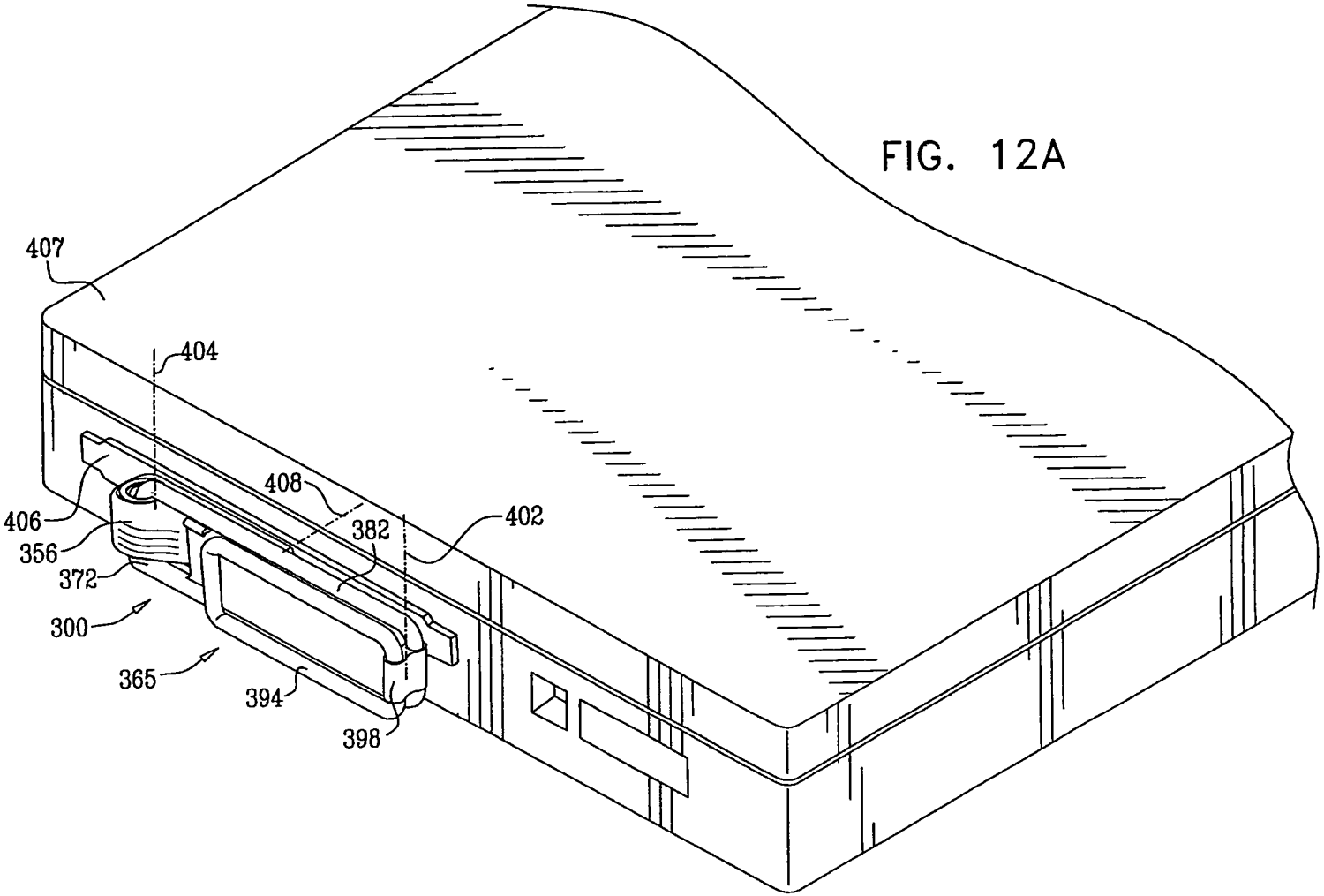
FIGS. 12A, 12B, 12C and 12D are simplified diagrammatic illustrations of the antenna of FIGS. 9-11C assembled onto a communications element which is usable in a mobile device, in four alternative orientations.

Turning specifically to FIG. 12A, the antenna 300 is seen lying generally parallel to a side of the communications element 406, and having the wire assembly 365 fully folded, such that wire portion 382 is folded onto housing element 356 and wire portion 394 is folded onto wire portion 382. Optionally, a snap retainer (not shown) may be provided on supporting arm 372, to hold wire portion 394 flat against wire portion 382 in this fully folded orientation. In this orientation, wire portions 382 and 394 lie generally parallel to the housing element 356. This orientation is particularly suitable for compact storage of antenna 300 while allowing antenna 300 limited functionality as a transmitter and/or receiver. It is appreciated that in the orientation shown in FIG. 4A, the width of the antenna 300 does not exceed that of the mobile device 407, thereby enabling compact storage thereof.

Figure 12B:
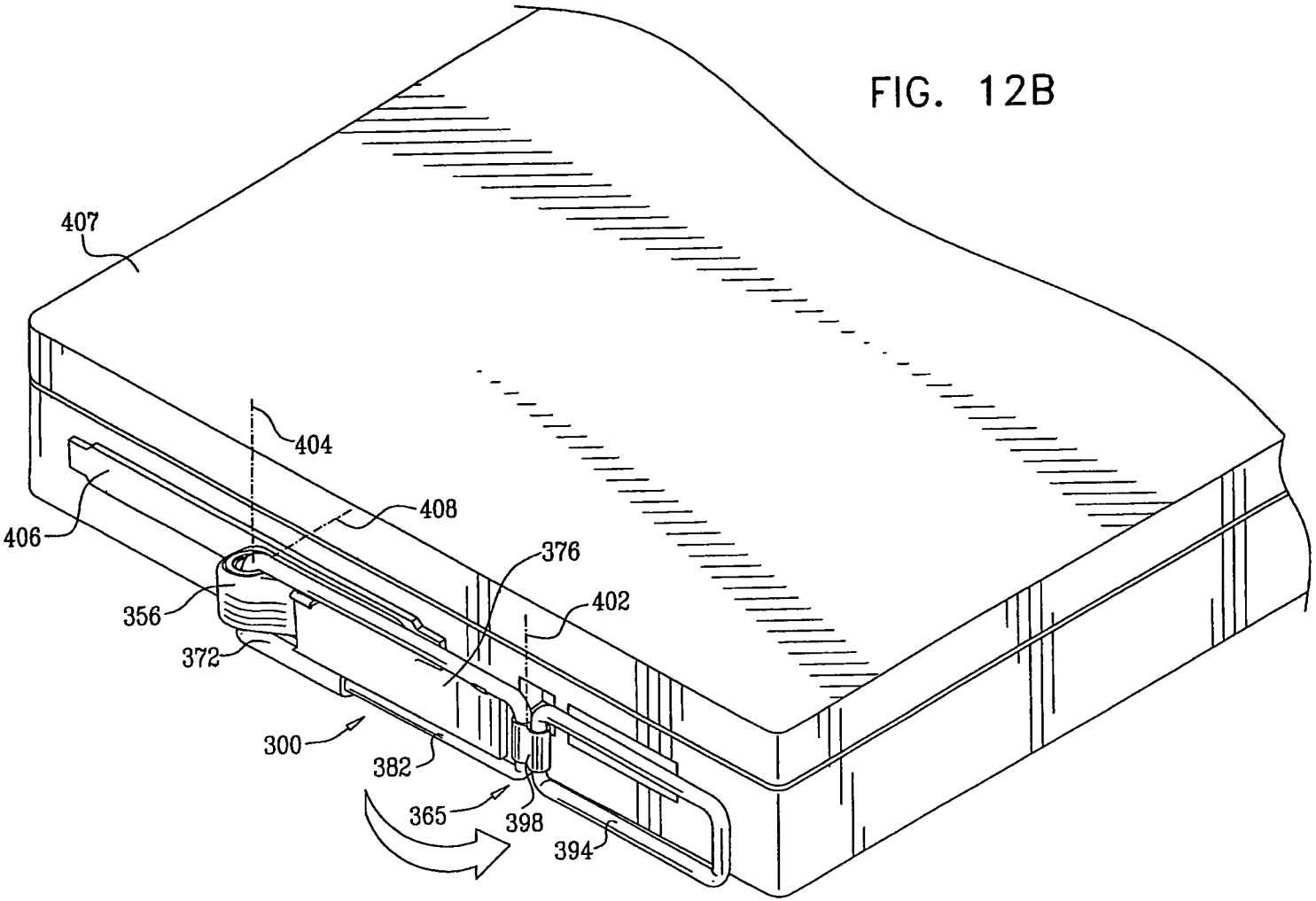

FIG. 12B illustrates the antenna 300 lying generally parallel to a side of the communications element 406, and having the wire assembly 365 partially folded, such that wire portion 382 is folded onto housing element 356 and wire portion 394 extends away from wire portion 382. In this orientation, wire portion 382 is generally coplanar with wire portion 394, and both lie generally parallel to the housing element 356. Rotation of wire portion 394 about axis 402, indicated by an arrow in FIG. 12B, changes the orientation of antenna 300 from that shown in FIG. 12A to this orientation. It is appreciated that in the orientation shown in FIG. 12B, the width of the antenna 300 does not exceed that of the mobile device 407, thereby enabling compact storage thereof.

Figure 12C:
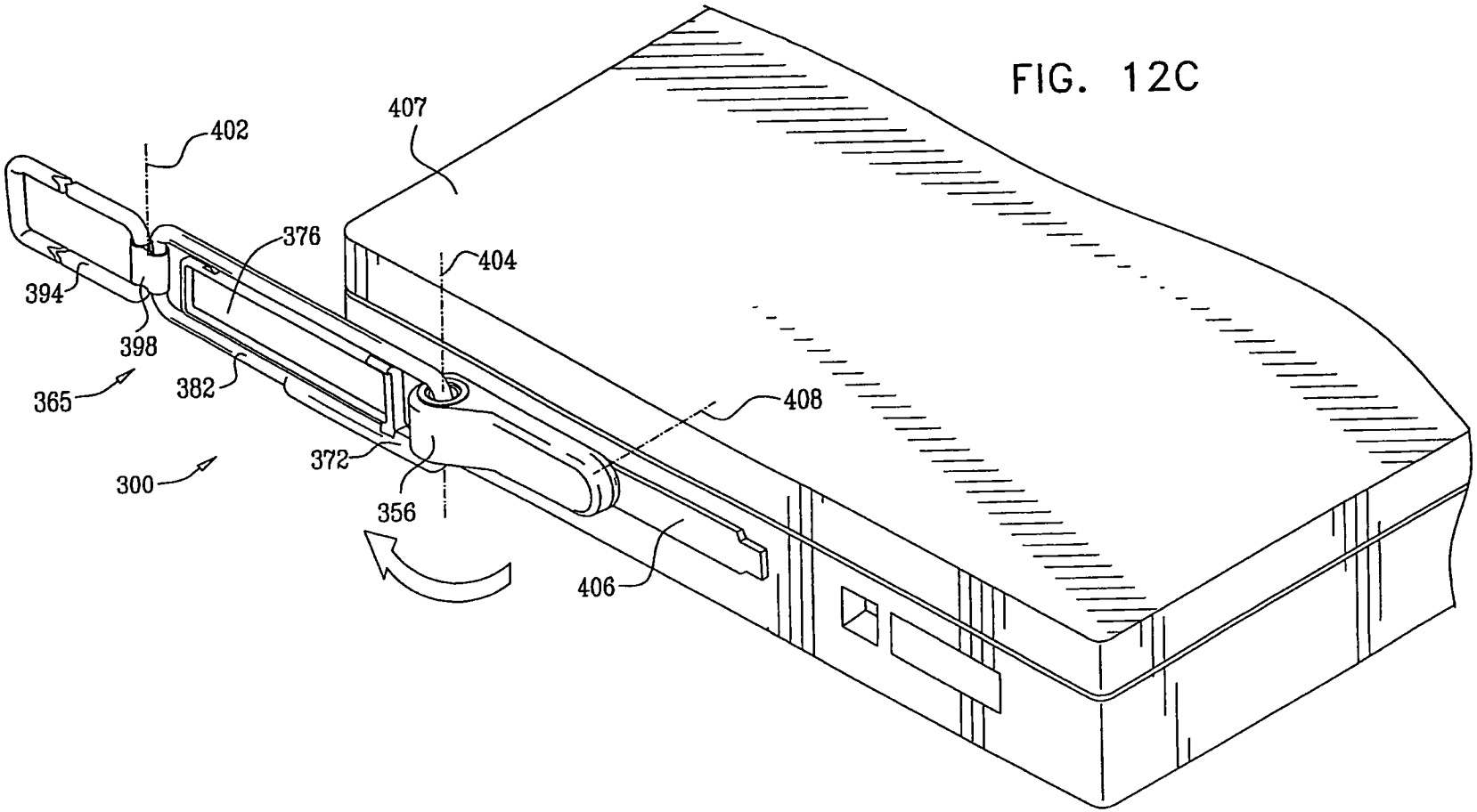

Turning to FIG. 12C, it is seen that the antenna 300 is lying generally parallel to a side of the communications element 406, and having wire portion 382 extending generally alongside housing element 356, and wire portion 394 extending generally alongside wire portion 382. Rotation of wire assembly 365 about axis 404, indicated by an arrow in FIG. 12C, changes the orientation of antenna 300 from that shown in FIG. 12B to this orientation.

Figure 12D:
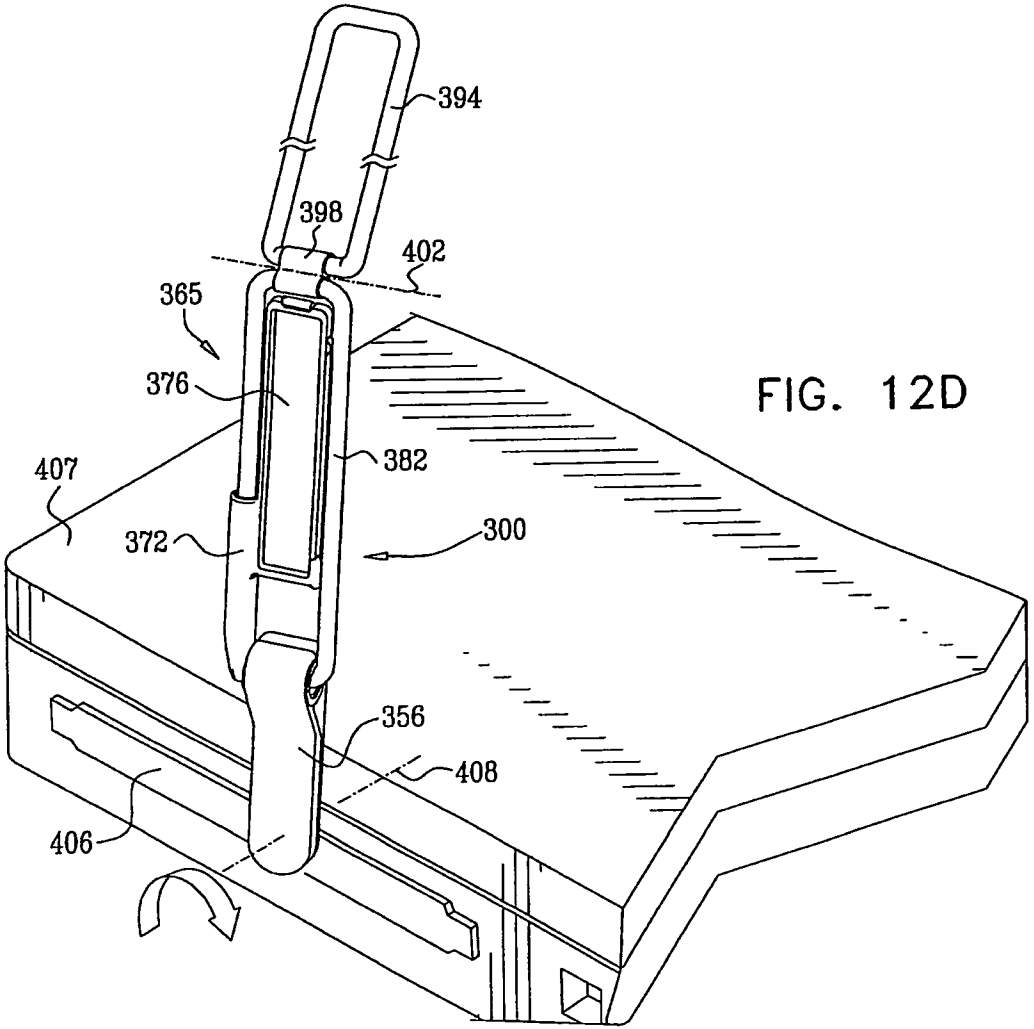

FIG. 12D illustrates the antenna 300 in a generally perpendicular orientation with respect to communications element 406. Rotation of antenna 300 about axis 408, as indicated by an arrow in FIG. 12D, changes the orientation of antenna 300 from that shown in FIG. 12C to this orientation. It is appreciated that in this orientation wire assembly 365 extends away from mobile device 407, thereby providing optimal antenna reception.

It is appreciated that the wire assembly 365 may assume any other orientation within the limits shown in FIGS. 10A, 10B and 10C, and that the antenna 300 may be positioned at any rotational angle with respect to communications element 406.

It is a particular feature of the present invention that the antenna 300 provides quadri-band functionality. A first band, which is typically a high frequency band, is affected by the length, and/or width of strip line antenna 318, with some lesser tuning contribution stemming from galvanic and near field RF coupling between the wire assembly 365 and housing element 356. A second band, which is typically another high frequency band, is affected by the length and/or width of wire portions 382 and 394. A third band may be provided when the antenna 300 is in a fully extended orientation, as shown in FIGS. 12C and 12D, by employing second order harmonics.

It is appreciated that in the fully extended orientation of antenna 300, as shown in FIGS. 12C and 12D, the antenna 300 provides reception in a fourth, low frequency band, and functions as a low frequency antenna which is particularly suitable for reception of television broadcasts, such as UHF bands, DVB-H and Qualcomm mediaflow.

It will be appreciated by persons skilled in the art that the present invention is not limited to what has been particularly shown and described hereinabove. Rather the scope of the present invention includes both combinations and subcombinations of the various features described hereinabove as well as modifications and variations thereof as would occur to a person of skill in the art upon reading the foregoing specification and which are not in the prior art.

The invention claimed is:

1. A multi-band antenna comprising:

a first antenna portion extending generally in a first plane;

a second antenna portion, extending generally in a second plane;

a hinged coupling providing coupling between said first antenna portion and said second antenna portion and permitting said second antenna portion to be folded over said first antenna portion such that said first plane and said second plane lie generally parallel; and a pivotable antenna connector coupled to said first antenna portion.

2. A multi-band antenna according to claim 1 and wherein said coupling comprises at least one of galvanic coupling and capacitive coupling.

3. A multi-band antenna according to claim 1 and wherein said first antenna portion comprises a strip line antenna.

4. A multi-band antenna according to claim 1 and wherein said second antenna portion comprises a wire bent in a generally rectangular shape whose dimensions exceed the dimensions of said first antenna portion.

5. A multi-band antenna according to claim 4 and wherein said second antenna portion is curved with respect to said second plane.

6. A multi-band antenna according to claim 5 and wherein said wire has a curvature diameter, said curvature diameter of said wire being less than or equal to twice a diameter of said wire.

7. A multi-band antenna according to claim 1 and wherein said multi-band antenna comprises a dual-band antenna, wherein said first antenna portion operates in a high frequency band and said second antenna portion operates in a low frequency band, when coupled to said first antenna portion.

8. A multi-band antenna according to claim 4, and wherein said wire comprises a first end and a second end, which are arranged generally in a mutually spaced parallel orientation.

9. A multi-band antenna according to claim 8 and wherein said multi-band antenna comprises a tri-band antenna.

10. A multi-band antenna according to claim 1 and wherein said pivotable antenna connector is coupled to said first antenna portion by at least one of galvanic coupling and capacitive coupling.

11. A multi-band antenna according to claim 1 and also comprising at least one electrical component operative to provide impedance matching.

12. A multi-band antenna according to claim 11 and wherein said at least one electrical component comprises at least one of an inductor and a capacitor.

13. A multi-band antenna according to claim 1 and also comprising a housing element formed around said first antenna portion.

14. A multi-band antenna according to claim 13 and wherein said housing element is molded around said first antenna portion.

15. A multi-band antenna according to claim 1 and also comprising a support element operative to support said second antenna portion.

16. A multi-band antenna comprising:

a first antenna portion extending generally in a first plane;

a second antenna portion, extending generally in a second plane; and a hinged coupling providing coupling between said first antenna portion and said second antenna portion and permitting said second antenna portion to be folded over said first antenna portion such that said first plane and said second plane lie generally parallel, said multi-band antenna being pivotably coupled to a communicating device, whereby said first antenna portion is pivotably coupled to said communicating device about a first axis and said second antenna portion is pivotably coupled to said first antenna portion about a second axis extending perpendicular to said first axis.

17. A multi-band antenna according to claim 16 and wherein when said second antenna portion is folded over said first antenna portion and said first antenna portion lies generally parallel to a side edge of said communicating device, said multi-band antenna having a width which does not exceed a width of said communicating device.

18. A multi-band antenna comprising:

a first antenna portion extending generally in a first plane;

a second antenna portion, extending generally in a second plane;

a hinged coupling providing coupling between said first antenna portion and said second antenna portion and permitting said second antenna portion to be folded over said first antenna portion such that said first plane and said second plane lie generally parallel; and a third antenna portion coupled to said second antenna portion.

19. A multi-band antenna according to claim 18 and wherein said third antenna portion is coupled to said second antenna portion by at least one of galvanic coupling and capacitive coupling.

20. A multi-band antenna according to claim 18 and also comprising a hinged coupling providing coupling between said second antenna portion and said third antenna portion and permitting said third antenna portion to be folded over said second antenna portion.

21. A multi-band antenna according to claim 20 and wherein said hinged coupling provides at least one of galvanic coupling and capacitive coupling.

22. A multi-band antenna according to claim 18 and wherein said multi-band antenna comprises a quadri-band antenna.

23. A multi-band antenna according to claim 18 and wherein said multi-band antenna is operative to operate in at least one low frequency band, which is suitable for reception of television broadcasts.

24. A multi-band antenna according to claim 18 and wherein said multi-band antenna is operative to employ second order harmonics thereby to operate in another band.

* * * * *